US006042987A

United States Patent [19]

Kobayashi

[11] Patent Number: 6,042,987

[45] Date of Patent: Mar. 28, 2000

[54] NEGATIVE TYPE IMAGE RECORDING MATERIAL

[75] Inventor: Fumikazu Kobayashi, Shizuoka-ken, Japan

[73] Assignee: Fuji Photo Film Co., Ltd, Minami-Ashigara, Japan

[21] Appl. No.: 08/949,707

[22] Filed: Oct. 14, 1997

[30] Foreign Application Priority Data

Oct. 16, 1996 [JP] Japan ..... 8-273392
Oct. 23, 1996 [JP] Japan ..... 8-280827

[51] Int. Cl.[7] ..... G03C 1/492

[52] U.S. Cl. ..... 430/270.1; 430/171; 430/914

[58] Field of Search ..... 430/171, 176, 430/914, 926, 270.1

[56] References Cited

U.S. PATENT DOCUMENTS

| | | | |
|---|---|---|---|
| 4,554,236 | 11/1985 | Bentley et al. | 430/157 |
| 4,927,739 | 5/1990 | Taniguchi et al. | 430/286 |
| 4,987,057 | 1/1991 | Kaji et al. | 430/281 |
| 5,153,236 | 10/1992 | Kaji et al. | 522/14 |
| 5,372,907 | 12/1994 | Haley et al. | 430/157 |
| 5,691,100 | 11/1997 | Kudo et al. | 430/170 |
| 5,725,994 | 3/1998 | Kondo | 430/270.1 |
| 5,731,125 | 3/1998 | Yamachika et al. | 430/270.1 |
| 5,756,650 | 5/1998 | Kawamonzen et al. | 528/353 |

FOREIGN PATENT DOCUMENTS 784233 7/1997 European Pat. Off. .

OTHER PUBLICATIONS

A. Lamola. et al, Chemically Amplified Resists in Solid State Technology, Aug. 1991, pp. 53–60.

*Primary Examiner*—Cynthia Hamilton
*Assistant Examiner*—Rosemary Ashton
*Attorney, Agent, or Firm*—Burns, Doane, Swecker & Mathis, LLP

[57] ABSTRACT

A negative type image recording material which is capable of effecting direct plate making by recording using a solid-state laser or semiconductor laser emitting an infrared-ray based on digital signals outputted from computers or the like, having components (A) to (E) which are more specifically a compound (A) which is degraded by the action of light or heat to generate an acid such as sulfonic acid or the like, a cross-linking agent (B) which has preferably two or more hydroxymethyl groups or alkoxymethyl groups, bonded to a benzene ring, which contains 3 to 5 benzene nuclei in the molecule, and which is cross-linked in the presence of an acid, such as a phenol derivative having a molecular weight of not greater than 1,200, at least one kind of alkali-soluble resin (C), an infrared absorbing agent (D), and organic basic compound (E) such as guanidine, aminomorpholine, pyridine and the like, or at least one compound selected from amino acids such as phenylalanine, tyrosine, alanylalanine, N-phenyl-β-alanine, nicotinic acid and the like and derivatives thereof.

10 Claims, No Drawings

NEGATIVE TYPE IMAGE RECORDING MATERIAL

BACKGROUND OF THE INVENTION

1. Field of the Invention

The present invention relates to an image recording material which can be used as a planographic printing plate material. More particularly, it relates to a negative type image recording material for a planographic printing plate material which is usable for the so-called direct plate making and which is capable of directly making a printing plate using an infrared laser based on digital signals outputted from a computer or the like.

2. Description of the Related Art

As systems of direct plate making from digital data of computers, there have hitherto been proposed (1) systems using an electrophotographic method, (2) systems using photopolymerization wherein exposure is carried out using a laser emitting blue or green light, (3) systems formed by laminating a silver salt layer on a photosensitive resin, (4) systems formed by a silver salt diffusion-transfer method and the like.

However, in (1) a system using an electrophotographic method, image forming processes such as electrification, exposure, development and the like are complicated and, therefore, apparatus becomes complicated and large. In (2) a system using photopolymerization, since the printing plate is highly sensitive to blue or green light, it becomes difficult to handle the plate in an illuminated room. In methods (3) and (4), since a silver salt is used, those methods have a disadvantage in that processes such as development and the like become complicated and also waste solutions contain silver.

On the other hand, laser technology has advanced remarkably in recent years and, particularly, high output and small-sized solid-state lasers and semiconductor lasers which emit infrared-rays having wavelengths of 760 nm to 1200 nm are easily available. These lasers are very useful as a light source for recording when direct plate making is carried out from the digital data of computers and the like. However, since many practically useful photosensitive recording materials are sensitive to visible light having wavelengths of not greater than 760 nm, image recording cannot be performed with these infrared lasers. For this reason, there is a demand for a material which is recordable with an infrared laser.

As an image recording material which is recordable with such infrared laser, there is a recording material comprising an onium salt, a resol resin, a novolak resin and an infrared light absorbing agent described in U.S. Pat. No. 5,372,907 corresponding to Japanese Patent Application Laid-Open (JP-A) No. 7-20629. In addition, a recording material comprising an s-triazine substituted with a haloalkyl group, a resol resin and a novolak resin, and an infrared light absorbing agent is described in Japanese Patent Application Laid-Open (JP-A) No. 7-271029. However, plate materials using these image recording materials have a problem in that staining is produced on non-image parts upon image formation and printing after being stored for a long period of time at high temperatures.

SUMMARY OF THE INVENTION

Accordingly, the object of the present invention is to provide a negative type image recording material suitable for a negative type planographic printing plate material, with which direct plate making can be performed from digital data of computers and the like by recording with a solid-state laser or semiconductor laser emitting an infrared ray, and which has excellent storability, in particular, storability under conditions of high temperature and high humidity.

The present inventors paid attention to and studied extensively components of a negative type image recording material and, as a result, found that the above object can be attained by using a negative type image recording material comprising an image recording layer containing the following (A) to (E) on a support, which resulted in completion of the present invention.

- a compound (A) which is degraded by the action of light or heat to generate an acid,
- a cross-linking agent (B) which cross-links in the presence of an acid,
- at least one alkali-soluble resin (C),
- an infrared absorbing agent (D),
- an organic basic compound or at least one compound (E) selected from amino acid and derivatives thereof.

As the cross-linking agent (B) which cross-links in the presence of an acid, a cross-linking agent having two or more hydroxymethyl groups oralkoxymethyl groups, within the molecule, which bond to a benzene ring, containing three to five benzene nuclei, and further containing at least one phenol derivative having a molecular weight of not greater than 1,200 is preferable.

In the negative type image recording material of the present invention, energy given by a solid-state laser or semiconductor laser which emits an infrared-ray is converted into thermal energy by an infrared absorbing agent (D), a compound (A) which can be degraded by the action of light or heat generates an acid, and this acid promotes a cross-linking reaction between a cross-linking agent (B) which cross-links in the presence of an acid and an alkali-soluble resin (C) and, whereby, image recording, that is, plate making of by the use of the recording material is effected. An organic basic compound or at least one compound (E) selected from an amino acid and derivatives thereof (hereinafter, referred to as "amino acid compound" for convenience), which is added to the system at an appropriate amount, captures an acid generated by degradation of a part of a compound (A) which is degraded by the action of light or heat to generate an acid under storage conditions or trace amounts of an acid contaminated therein from the atmosphere, to depress cross-linking at an unexposed part of the recording material, i.e., to depress generation of fog accordingly, storability of the negative type image recording material is remarkably improved.

DESCRIPTION OF THE PREFERRED EMBODIMENTS

Each of the essential components of the present invention will be successively explained below. First, the organic basic compound (E) which is a characteristic component in the present invention will be explained.

[Organic Basic Compound (E)]

A preferable organic basic compound which may be used in the present invention is a compound stronger in basicity than phenol. Of these, nitrogen-containing basic compounds are exemplified.

As preferable organic basic compounds, the structures of the following formulae (XIII) to (XVI) are exemplified.

Formula (XIII)

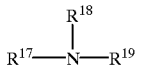

wherein $R^{17}$, $R^{18}$ and $R^{19}$ may be the same or different and are a hydrogen atom, an alkyl group having 1 to 6 carbon atoms, an aminoalkyl group having 1 to 6 carbon atoms, a hydroxyalkyl group having 1 to 6 carbon atoms, or an optionally substituted aryl group having 6 to 20 carbon atoms. $R^{17}$ and $R^{18}$ may be linked to each other to form a ring.

Formula (XIV)

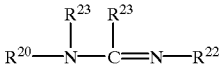

Formula (XV)

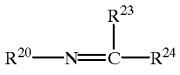

Formula (XVI)

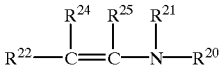

wherein $R^{20}$, $R^{21}$ and $R^{22}$ may be the same or different and are a hydrogen atom, an alkyl group having 1 to 6 carbon atoms, an aminoalkyl group having 1 to 6 carbon atoms, a hydroxyalkyl group having 1 to 6 carbon atoms, or an optionally substituted aryl group having 6 to 20 carbon atoms. $R^{23}$, $R^{24}$ and $R^{25}$ are the same or different and represent an alkyl group having 1 to 6 carbon atoms or a substituted alkyl group, wherein any two of $R^{20}$ to $R^{25}$ may be linked to each other to form a ring.

A nitrogen-containing basic compound having two or more nitrogen atoms of different chemical environments in one molecule is also a preferable compound. Preferable examples thereof are a substituted or unsubstituted guanidine, a substituted or unsubstituted aminopyridine, a substituted or unsubstituted aminoalkylpyridine, a substituted or unsubstituted aminopyrrolidine, a substituted or unsubstituted imidazole, a substituted or unsubstituted pyrazole, a substituted or unsubstituted pyrazine, a substituted or unsubsituted pyrimidine, a substituted or unsubstituted purine, a substituted or unsubstituted imidazoline, a substituted or unsubstituted pyrazoline, a substituted or unsubstituted piperazine, a substituted or unsubstituted aminomorpholine, a substituted or unsubstituted aminoalkylmorpholine and the like.

Examples of preferable substituents are an amino group, an aminoalkyl group, an alkylamino group, an aminoaryl group, an arylamino group, an alkyl group, an alkoxy group, an acyl group, an acyloxy group, an aryl group, an aryloxy group, a nitro group, a hydroxyl group, a cyano group and the like.

More particularly, preferable compounds include guanidine, 1,1-methylguanidine, 1,1,3-tetramethylguanidine, 2-aminopyridine, 3-aminopyridine, 4-aminopyridine, 2-dimethylaminopyridine, 4-dimethylaminopyridine, 2-diethylaminopyridine, 2-(aminomethyl)pyridine, 2-amino-3-methylpyridine, 2-amino-4-methylpyridine, 2-amino-5-methylpyridine, 2-amino-6-methylpyridine, 3-aminoet-hylpyridine, 4-aminoethylpyridine, 3-aminopyrrolidine, piperazine, N-(2-aminoethyl)piperazine, N-(2-aminoethyl)piperidine, 4-amino-2,2,6,6-tetramethylpiperidine, 4-piperidinopiperidine, 2-aminopiperidine, 1-(2-aminoethyl)pyrrolidine, pyrazole, 3-amino-5-methylpyrazole, 5-amino-3-methyl-1-p-tolylpyrazole, pyridine, 2-(aminomethyl)-5-methylpyrazine, pyrimidine, 2,4-diaminopyrimidine, 4,6-dihydroxypyrimidine, 2-pyrazoline, 3-pyrazoline, N-aminomorpholine, N-(2-aminoethyl)morpholine and the like.

Examples of organic basic compounds which may be preferably used in the present invention are listed here but are not limited thereto.

Trialkylamines such as tri-n-octylamine, tribenzylamine, triethanolamine and the like; anilines such as N,N-diethylaniline, N,N-dibenzylaniline, N-phenylmorpholine and the like; cyclic amines such as N,N'-bis(hydroxyethyl) piperazine, 1-(2-hydroxyethyl)piperidine, 2-(2-hydroxyethyl)piperidine, 4-(2-hydroxyethyl)piperidine, 1-(2-hydroxyethyl)-4-(3-hydroxypropyl)piperidine, 2-(2-hydroxyethyl)-1-methylpyrrolidine, 1-[N-(2-hydroxyethyl)-4-piperidinyl]-3-(4'-piperidinyl)propane and the like; pyridines such as 2,6-lutidine, collidine, N,N-dimethylnicotinamide, 4-(N,N-dimethylamino)pyridine and the like; other compounds such as dipyridanol and the like are preferably used.

These basic compounds are used alone or in combination of two or more. The amount of basic compound to be used is preferably 0.001 to 10 parts by weight, more preferably 0.01 to 5 parts by weight based on 100 parts by weight of whole solid components in an image recording layer of the negative type image recording material. When the amount is less than 0.001 parts by weight, it is difficult to achieve the effects of the present invention, and, when the amount exceeds 10 parts by weight, remarkable reduction in sensitivity is observed.

Next, at least one compound selected from an amino acid and derivatives thereof which are another component of (E) is explained.

[At least one compound (E) selected from an amino acid and derivatives thereof]

An amino acid and derivatives thereof in the present invention include an N-substituted amino acid in which a hydrocarbon group is introduced therein and peptides having an amino acid as a constituent unit in addition to a so-called amino acid having carboxyl group and amino group in one molecule.

Preferable amino acids which may be used in the present invention include glycine, alanine, β-alanine, valine, norvaline, leucine, norleucine, isoleucine, phenylalanine, tyrosine, diiodotyrosine, surinamine, threonine, serine, proline, hydroxyproline, tryptophan, thyroxine, methionine, cystine, cysteine, γ-aminobutyricacid, aspartic acid, glutamine acid, asparagine, glutamine, lysine, hydroxylysine, arginine, histidine and the like.

Substituents which may be introduced into the N-substituted amino acid, include a hydrocarbon group having not greater than 15 carbon atoms, for example, an alkyl group such as a methyl group, an ethyl group, a propyl group, an isopropyl group and the like; an alkenyl group such as a vinyl group, an allyl group and the like; an aryl group such as a phenyl group, a naphthyl group and the like; an aralkyl group such as a benzyl group and the like. More particularly, examples of the N-substituted amino acid having such a substituent are N-methylglycine, N-phenylglycine, N-phenyl-β-alanine, N,N-dimethylglycine and the like.

As the peptides having amino acid as a constituent unit, oligopeptides having not greater than 10 amino acid repeating units are preferably used. As the number of amino acid repeating units increases, an equivalent per molecular weight of a terminal amino group and a carboxyl group decreases, so that the compound does not exert its buffering effect which contributes to storability. Particular examples of preferable oligopeptides are dipeptides such as glycylglycine, alanylalanine and the like, a sweetener, Aspartame (trade name; manufactured by Ajinomoto K. K.) obtained from the raw materials phenylalanine and aspartic acid.

These amino acid compounds are used alone or in combination of two or more. The amount of the amino acid compound to be added is 0.001% the to 10% by weight, preferably 0.01% to 5% by weight relative to the total solid components in the image recording layer of the negative type image recording material. When the amount is less than 0.001% by weight, the effects of the present invention cannot be attained and, when the amount exceeds 10% by weight, there is the possibility that a remarkable reduction in sensitivity arises.

The components other than component (E) in the present negative type image recording material will be explained below.

[A compound (A) which is degraded by the action of light or heat to generate an acid]

The compound which is degraded by the action of light or heat to generate an acid (hereinafter, referred to as "acid generator" for convenience) refers to a compound which generates an acid by irradiation with light having a wavelength of 200 nm to 500 nm or by heating at a temperature of at least 100° C. As the acid generator which can preferably be used in the present invention, an initiator for photocationic polymerization, an initiator for photo-radical polymerization, a quencher for dyes, a discoloring agent, known acid generators used in the microresist and the like, known compounds which are thermally degraded to generate an acid, and a mixture thereof may be conveniently selected for use.

For example, these compounds include diazonium salts describedins. S. I. Schlesinger, Photogr. Sci. Eng., 18, 387 (1974), T. S. Bal et al., Polymer, 21, 423 (1980), ammonium salts described in U.S. Pat. Nos. 4,069,055, 4,069,056, Re27,992, Japanese Patent Application Laid-Open (JP-A) No. 4-365049, a phosphonium salt described in D. C. Necker et al., Macromolecules, 17, 2468 (1984), C. S. Wen et al., Teh, Proc. Conf. Rad, Curing ASIA, p478 Tokyo, October (1988), U.S. Pat. Nos. 4,069,055 and 4,069,056, iodonium salts described in J. V. Crivello et al., Macromolecules, 10(6), 1307 (1977), Chem. & Eng. News, Nov. 28, p31 (1988), EP Patent No. 104,143, U.S. Pat. Nos. 339,049 and 410,201, Japanese Patent Application Laid Open (JP-A) Nos. 2-150848 and 2-296514, sulfonium salts described in J. V. Crivello et al., Polymer J. 17, 73 (1985), J. V. Crivello et al., J. Org. Chem., 43, 3055 (1978), W. R. Watt et al., J. Polymer Sci., Polymer Chem. Ed., 22, 1789 (1984), J. V. Crivello et al., Polymer Bull., 14, 279 (1985), J. V. Crivello et al., Macromolecules, 14(5), 1141 (1981), J. V. Crivello et al., J. Polymer Sci., Polymer Chem. Ed., 17, 2877 (1979), EP Patent Nos. 370,693, 390,214, 233,567, 297,443 and 297,442, U.S. Pat. Nos. 4,933,377, 161,811, 410,201, 339,049, 4,760,013, 4,734,444 and 2,833,827, DE Patent Nos. 2,904,626, 3,604,580 and 3,604,581, selenonium salts described in J. V. Crivello et al., Macromolecules, 10(6), 1307 (1977), J. V. Crivello et al., J. Polymer Sci., Polymer Chem. Ed., 17, 1047 (1979), onium salts such as arsonium salts and the like described in C. S. Wen. et al., Teh, Proc. Conf. Rad. Curing ASIA, p478 Tokyo, October (1988), organic halogen compounds describedin U.S. Pat. No. 3,905,815, Japanese Patent Application Publication (JP-B) No. 46-4605, Japanese Patent Application Laid-Open (JP-A) Nos. 48-36281, 55-32070, 60-239736, 61-169835, 61-169837, 62-58241, 62-212401, 63-70243, and 63-298339, organic metal/organic halogenated compounds described in K. Meier et al., J. Rad. Curing, 13(4), 26(1986), T. P. Gill et al., Inorg. Chem., 19, 3007 (1980), D. Astruc, Acc. Chem. Res., 19(12), 377 (1896), Japanese Patent Application Laid-Open (JP-A) No. 2-161445, photoacid generators having an o-nitrobenzyl type protecting group described in S. Hayase et al., J. Polymer Sci., 25, 753 (1987), E. Reichmanis et al., J. Polymer Sci., Polymer Chem. Ed., 23, 1(1985), Q. Q. Zhu et al., J. Photochem., 36, 85, 39, 317 (1987), B. Amit et al., Tetrahedron Lett., (24)2205 (1973), D. H. R. Barton et al., J. Chem. Soc. 3571 (1965), P. M. Collins et al., J. Chem. Soc., Perkin I, 1695 (1975), M. Rudinstein et al., Tetrahedron Lett., (17), 1445 (1975), J. W. Walker et al., J. Am. Chem. Soc., 110, 7170 (1988), S. C. Busman et al., J. Imaging Technol., 11(4), 191(1985), H. M. Houlihan etal., Macromolecules, 21, 2001 (1988), P. M. Collins etal., J. Chem. Soc., Chem. Commun., 532(1972), S. Hayase et al., Macromolecules, 18, 1799 (1985), E. Reichmanis et al., J. Electrochem. Soc., Solid State Sci. Technol., 1(6), F. M. Houlihan etal., Macromolecules, 21, 2001 (1988), EP Patent Nos. 0290,750, 046,083, 156,535, 271,851 and 0,388,343, U.S. Pat. Nos. 3,901,710 and 4,181,531, Japanese Patent Application Laid-Open (JP-A) Nos. 60-198538 and 53-133022, compounds which photo-degraded to generate sulfonic acid, a representative of which is an iminosulfonate or the like, described in M. Tunooka et al., Polymer Preprints Japan, 38(8), G. Berner et al., J. Rad. Curing, 13(4), W. J. Mijs et al., Coating Technol., 55 (697), 45 (1983), Akzo, H. Adachi et al., Polymer Preprints, Japan, 37(3), EP Patent Nos. 0199,672, 84515, 199,672, 044,115 and 0101,122, U.S. Pat. Nos. 4,618,564, 4,371,605 and 4,431,774, Japanese Patent Application Laid-Open (JP-A) Nos. 64-18143, and 2-245756, and Japanese Patent Application No. 3-140109, and disulfone compounds described in Japanese Patent Application Laid-Open (JP-A) No. 61-166544.

Compounds in which a group or a compound generating an acid is introduced on a main chain or a side chain of a polymer, for example, those described in M. E. Woodhouse et al., J. Am. Chem. Soc., 10, 5586 (1982), S. P. Pappas et al., J. Imaging Sci., 30(5), 218 (1986), S. Kondo et al., Makromol. Chem., Rapid. Commun., 9, 625 (1988), Y. Yamada et al., Makromol. Chem., 152, 153, 163 (1972), J. V. Crivello et al., J. Polymer Sci., Polymer Chem. Ed., 17, 3845 (1979), U.S. Pat. No. 3,849,137, DE Patent No. 3,914,407, Japanese Patent Application Laid-Open (JP-A) Nos. 63-26653, 55-164824, 62-69263, 63-146037, 63-163452, 62-153853, and 63-146029 may be used.

Further, compounds which generate an acid by the action of light described in V. N. R. Pillai, Synthesis, (1), 1(1980), A. Abad. et al., Tetrahedron Let., (47) 4555 (1971), D. H. R. Barton et al., J. Chem. Soc., (C), 329 (1970), U.S. Pat. No. 3,779,778, EP Patent No. 126,712 and the like may be used.

Among them, acid generators which are particularly preferable include compounds represented by the following general formulas (I) to (V).

(I)

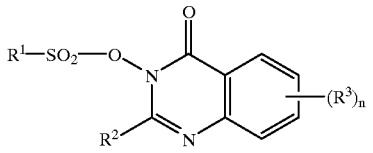

(II)

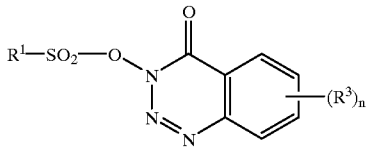

(III)

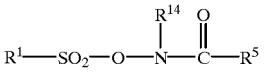

(IV)

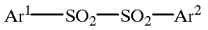

(V)

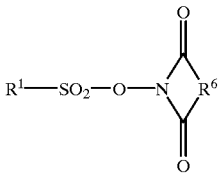

wherein $R^1$, $R^2$, $R^4$ and $R^5$ may be the same or different and each represents an optionally substituted hydrocarbon group having no more than 20 carbon atoms. $R^3$ represents a halogen atom, an optionally substituted hydrocarbon group having not greater than 10 carbon atoms or an alkoxy group having not greater than 10 carbon atoms. $Ar^1$ and $Ar^2$ may be the same or different and represent an optionally substituted aryl group having not greater than 20 carbon atoms. $R^6$ represents an optionally substituted divalent hydrocarbon group having not greater than 20 carbon atoms. n represents an integer of 0 to 4.

In the general formulas (I) to (V), $R^1$, $R^2$ $R^4$ and $R^5$ each represents an independently optionally substituted hydrocarbon group having not greater than 20 carbon atoms, preferably a hydrocarbon group having 1 to 14 carbon atoms.

Examples of the hydrocarbon group include an alkyl group such as a methyl group, an ethyl group, a n-propyl group, an i-propyl group, a n-butyl group, a sec-butyl group, a t-butyl group, a hexyl group, a cyclohexyl group, an octyl group, a 2-ethylhexyl group, an undecyl group, a dodecyl group and the like, an alkenyl group such as an allyl group, a vinyl group, a 1-methylvinyl group, a 2-phenylvinyl group and the like, an aralkyl group such as a benzyl group and the like, an aryl group such as a phenyl group, a tolyl group, a xylyl group, a cumenyl group, a mesityl group, a dodecylphenyl group, a phenylphenyl group, a naphthyl group, an anthracenyl group and the like.

These hydrocarbon groups may have a substituent such as a halogen atom, an alkoxy group, a nitro group, a cyano group, a carboxyl group and the like. Examples of the hydrocarbon groups having a substituent include a trifluoromethyl group, a chlroethyl group, a 2-methoxyethyl group, a fluorophenyl group, a chgorophenyl group, a bromophenyl group, an iodophenyl group, a methoxyphenyl group, a phenoxyphenyl group, a methoxyphenylvinyl group, a nitrophenyl group, a cyanophenyl group, a carboxyphenyl group, a 9,10-dimethoxy anthracenyl group and the like.

$R^3$represents a halogen atom, an optionally substituted hydrocarbon group having not greater than 10 carbon atoms (for example, an alkyl group, alkenyl group, aralkyl group, aryl group), or an alkoxy group having not greater than 10 carbon atoms.

More particularly, $R^3$ includes a halogen atom such as fluorine, chlorine, bromine and iodine, a hydrocarbon group such as a methyl group, an ethyl group, a n-propyl group, an i-propyl group, an allyl group, a n-butyl group, a sec-butyl group, a t-butyl group, an hexyl group, a cyclohexyl group, a benzyl group, a phenyl group, a tolyl group and the like, a hydrocarbon group having a substituent such as a 2-methoxyethyl group, a fluorophenyl group, a chlorophenyl group, a bromophenyl group, an iodophenyl group, a methoxyphenyl group and the like, an alkoxy group such as a methoxy group, an ethoxy group and the like.

When n is two or more, adjacent two $R^3$ groups may be linked to each other to form a condensed ring.

$Ar^1$ and $Ar^2$ may be the same or different and each represents an optionally substituted aryl group having not greater than 20 carbon atoms, preferably an aryl group having 6 to 14 carbon atoms.

Examples thereof include a phenyl group, tolyl group, xylyl group, cumenyl group, mesityl group, dodecylphenyl group, phenylphenyl group, naphthyl group, fluorophenyl group, chlorophenyl group, bromophenyl group, iodophenyl group, chloronaphthyl group, methoxyphenyl group, phenoxyphenyl group, ethoxynaphthyl group, nitrophenyl group, cyanophenyl group, carboxyphenyl group, nitronaphthyl group, anthracenyl group and the like.

$R^6$ represents an optionally substituted divalent hydrocarbon group having not greater than 20 carbon atoms (for example, an alkylyne group, alkenylene group, aralkylene group and arylene group).

Examples thereof include an ethynylene group, 1,2-cyclohexenylyne group, 1,2-phenylene group, 4-chloro-1,2-phenylene group, 4-nitro-1,2-phenylene group, 4-methyl-1,2-phenylene group, 4-methoxy-1,2-phenylene group, 4-carboxy-1,2-phenylene group, 1,8-naphthalenylene group and the like.

n represents an integer of 0 to 4. When n is 0, it means that $R^3$ is not present, i.e., hydrogen atoms are present on the ring.

Among the compounds represented by the general formulae (I) to (V), the following compounds are preferable.

These compounds can be synthesized by a method described in Japanese Patent Application Laid-Open (JP-A) Nos. 2-100054 and 2-100055.

(I-1)

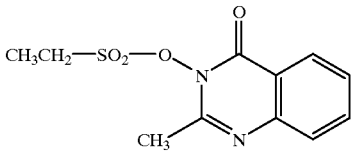

(I-2)

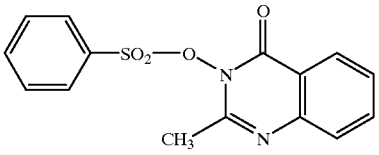

-continued
(I-3)
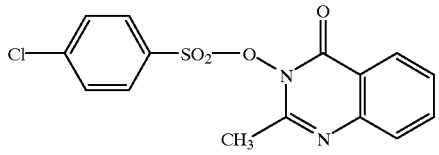
(I-4)
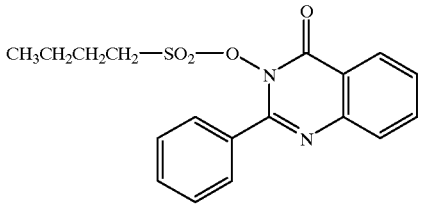
(I-5)
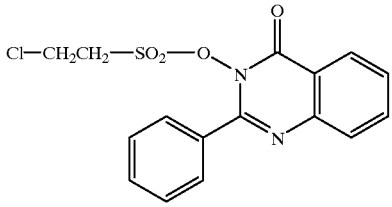
(I-6)
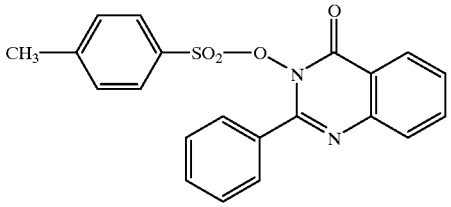
(I-7)
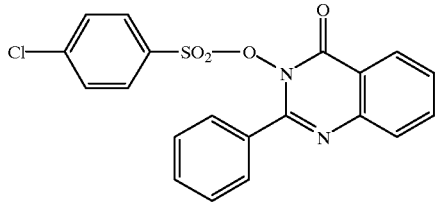
(I-8)
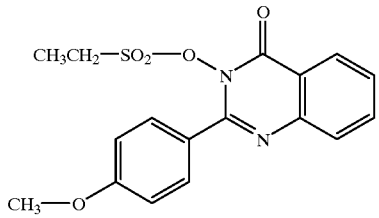
(I-9)
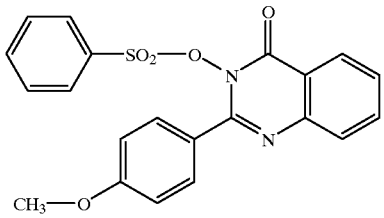
-continued
(I-10)
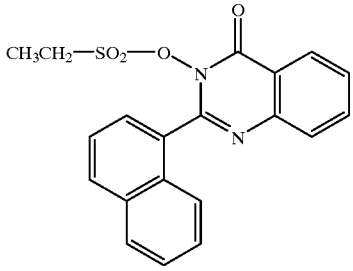
(I-11)
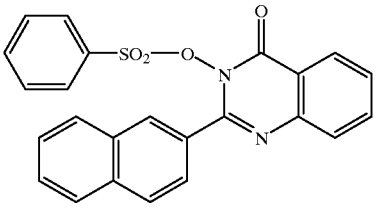
(I-12)
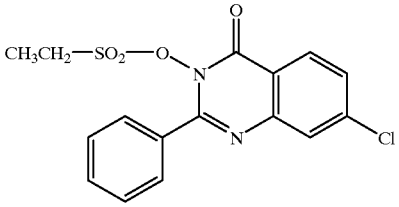
(I-13)
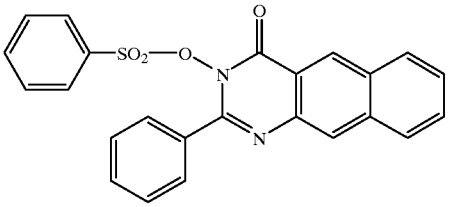
(I-14)
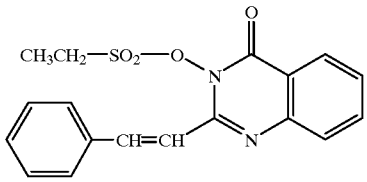
(I-15)
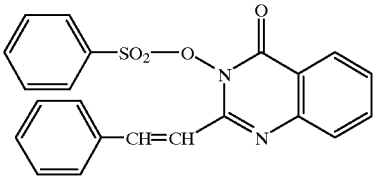
(I-16)
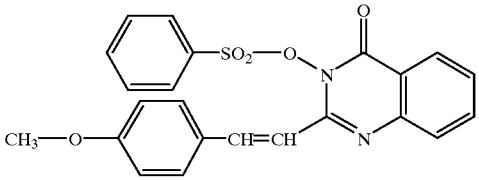

-continued
(II-1)
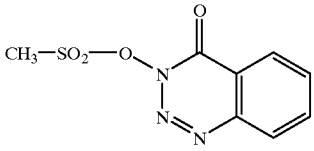
(II-2)
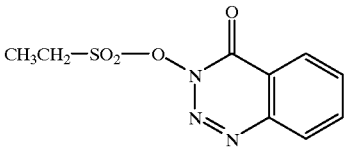
(II-3)
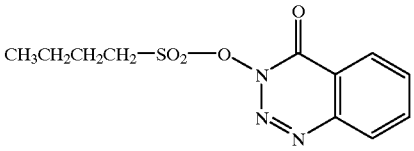
(II-4)
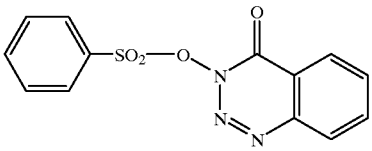
(II-5)
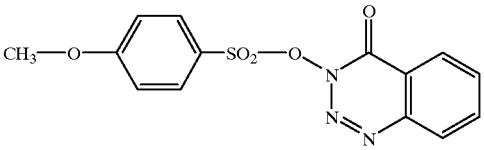
(II-6)
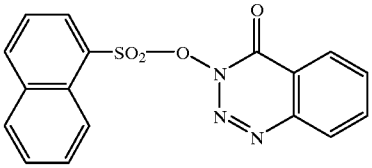
(III-1)
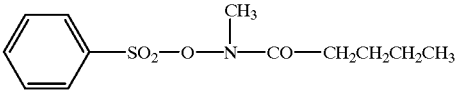
(III-2)
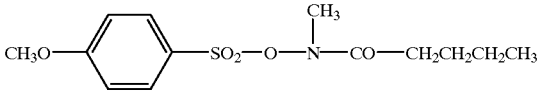
(III-3)
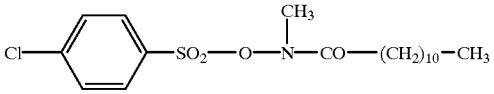
(III-4)
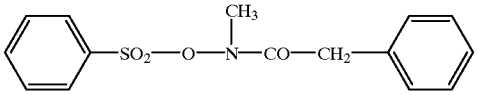
-continued
(III-5)
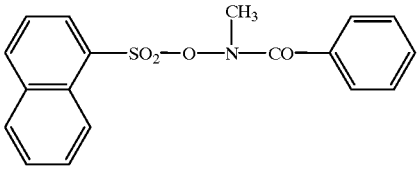
(III-6)
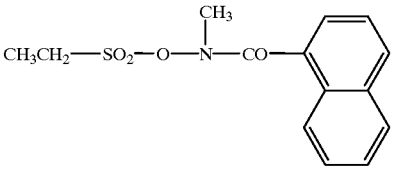
(III-7)
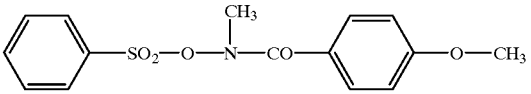
(III-8)
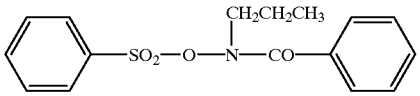
(III-9)
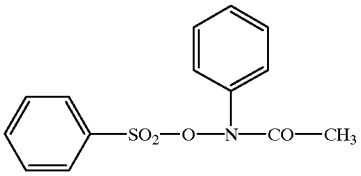
(III-10)
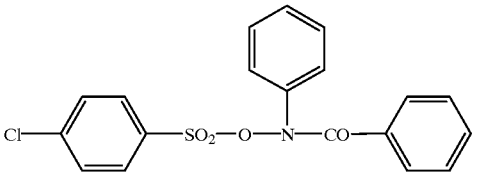
(III-11)
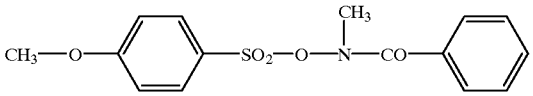
(III-12)
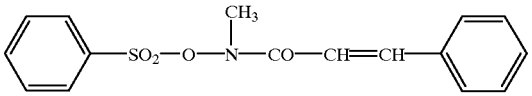
(III-13)
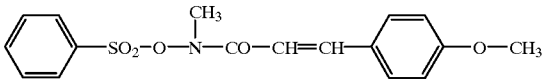
(III-14)
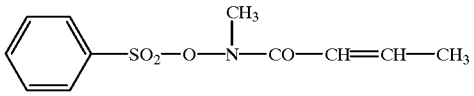
(IV-1)
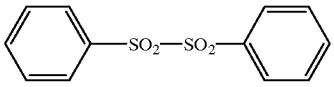

-continued
(IV-2)
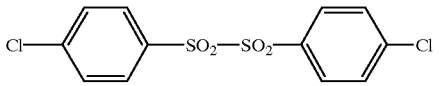
(IV-3)
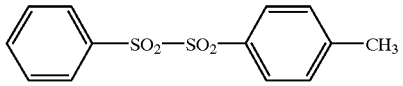
(IV-4)
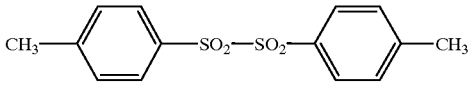
(IV-5)
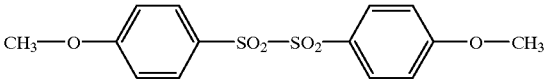
(IV-6)
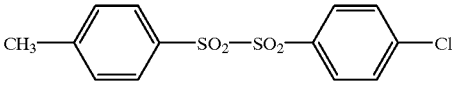
(IV-7)
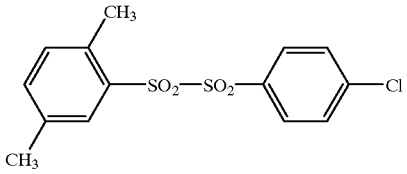
(IV-8)
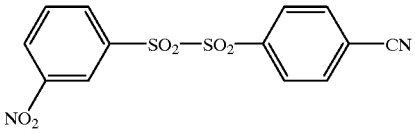
(IV-9)
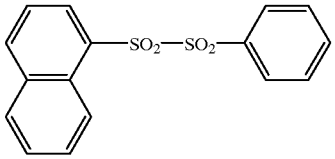
(IV-10)
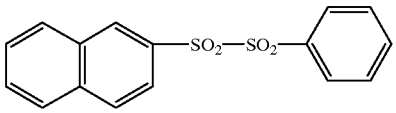
(IV-11)
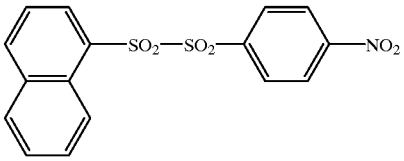
(IV-12)
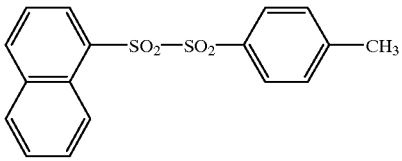
-continued
(IV-13)
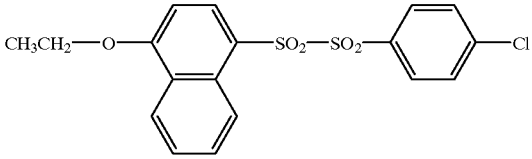
(IV-14)
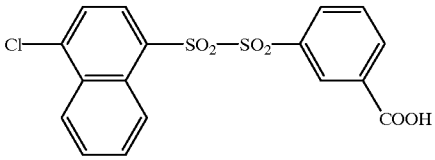
(IV-15)
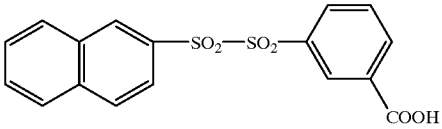
(IV-16)
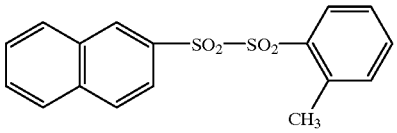
(IV-17)
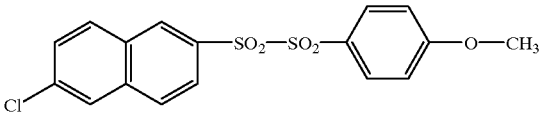
(V-1)
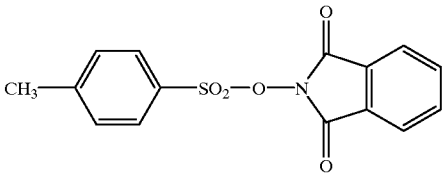
(V-2)
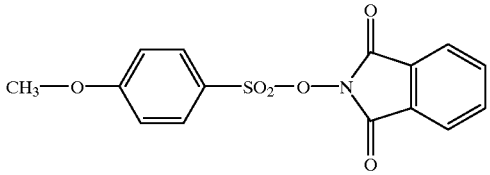
(V-3)
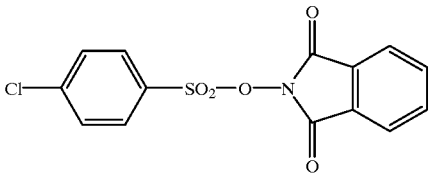
(V-4)
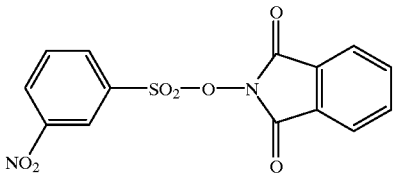

-continued (V-5)

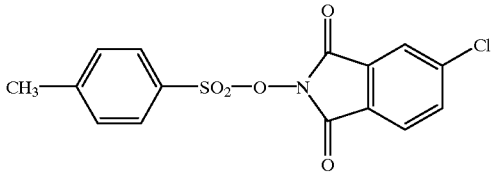

(V-6)

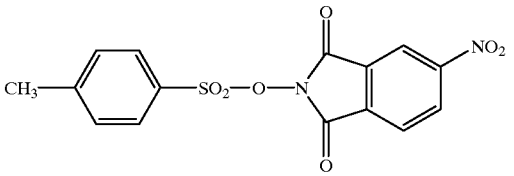

(V-7)

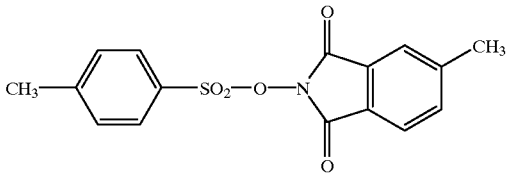

(V-8)

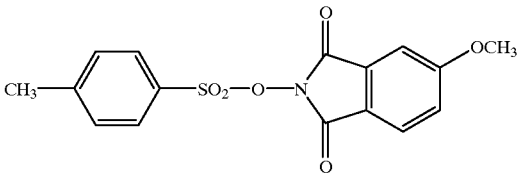

(V-9)

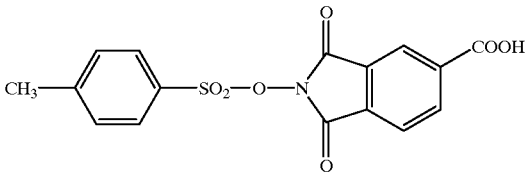

(V-10)

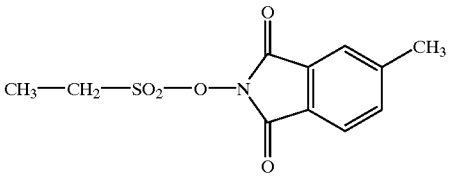

(V-11)

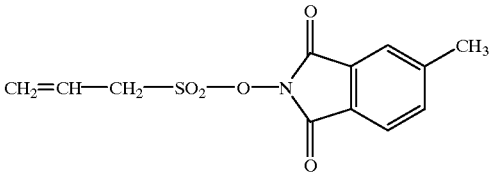

(V-12)

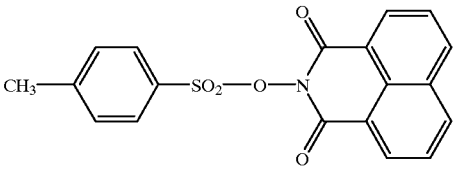

-continued (V-13)

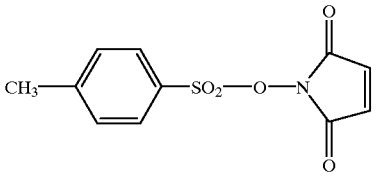

(V-14)

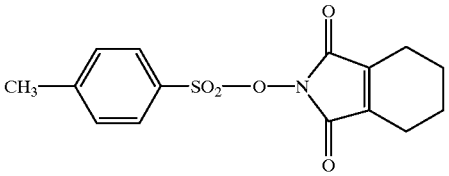

(V-15)

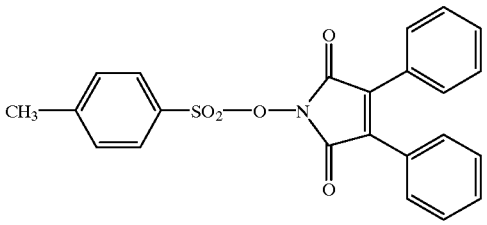

(V-16)

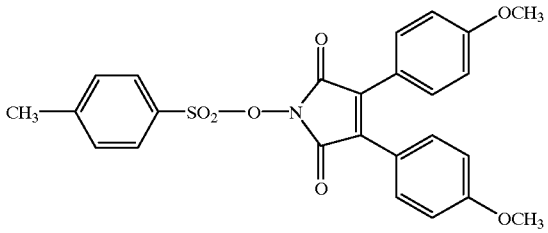

(V-17)

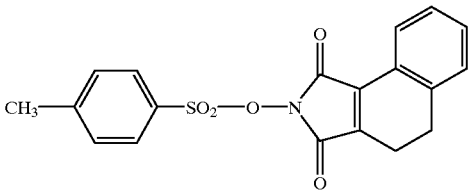

(V-18)

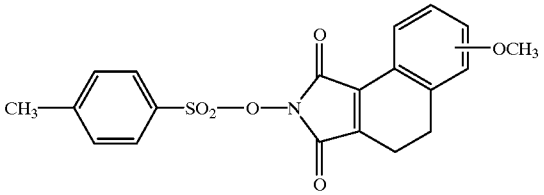

In addition, the compound (A) which is degraded by the action of light or heat to generate an acid, includes an onium salt having a halide or a sulfonic acid as a counter ion, for example, those having any structure of an iodonium salt, sulfonium salt and diazonium salt represented by the following general formulae (VI) to (VIII).

General formula (VI)

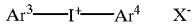

-continued

General formula (VII)

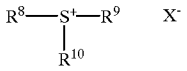

General formula (VIII)

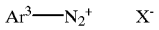

wherein $X^-$ represents a halide ion, $ClO_4^-$, $PF_6^-$, $SbF_6^-$, $BF_4^-$, or $R^7$–$SO_3^-$, wherein $R^7$ represents an optionally substituted hydrocarbon group having not greater than 20 carbon atoms. $Ar^3$ and $Ar^4$ each represents an optionally substituted aryl group having not greater than 20 carbon atoms. $R^8$, $R^9$ and $R^{10}$ each represents an optionally substituted hydrocarbon group having not greater than 18 carbon atoms.

In the above formulae, as $X^-$, $R^7$—$SO_3^-$ is particularly preferably used, wherein $R^7$represents an optionally substituted hydrocarbon group having not greater than 20 carbon atoms. Examples of the hydrocarbon group represented by $R^7$ include an alkyl group such as methyl group, ethyl group, n-propyl group, i-propyl group, allyl group, n-butyl group, sec-butyl group, t-butyl group, hexyl group, cyclohexyl group, octyl group, 2-ethylhexyl group, dodecyl group and the like, an alkenyl group such as vinyl group, 1-methylvinyl group, 2-phenylvinyl and the like, an aralkyl group such as benzyl group, phenethyl group and the like, and an aryl group such as phenyl group, tolyl group, xylyl group, cumenyl group, mesityl group, dodecylphenyl group, phenylphenyl group, naphthyl group, anthracenyl group and the like.

These hydrocarbon groups may have a substituent, for example, a halogen atom, hydroxyl group, alkoxy group, allyloxy group, nitro group, cyano group, carbonyl group, carboxyl group, alkoxycarbonyl group, anilino group, acetamide group and the like Examples of the hydrocarbon group having a substituent include trifluoromethyl group, 2-methoxyethyl group, 10-camphanyl group, fluorophenyl group, chlorophenyl group, bromophenyl group, iodophenyl group, methoxyphenyl group, hydroxyphenyl group, phenoxyphenyl group, nitrophenyl group, cyanophenyl group, carboxyphenyl group, methoxynaphthyl group, dimethoxyanthracenyl group, diethoxyanthracenyl group, anthraquinonyl group and the like.

$Ar^3$ and $Ar^4$ each represents an optionally substituted aryl group having not greater than 20 carbon atoms. Examples thereof include a phenyl group, tolyl group, xylyl group, cumenyl group, mesityl group, dodecylphenyl group, phenylphenyl group, naphthyl group, anthracenyl group, fluorophenyl group, chlorophenyl group, bromophenyl group, iodophenyl group, methoxyphenyl group, hydroxyphenyl group, phenoxyphenyl group, nitrophenyl group, cyanophenyl group, carboxyphenyl group, anilinophenyl group, anilinocarbonylphenyl group, morpholinophenyl group, phenylazophenyl group, methoxynaphthyl group, hydroxynaphthyl group, nitronaphthyl group, anthraquinonyl group and the like.

$R^8$, $R^9$ and $R^{10}$ each represents independently an optionally substituted hydrocarbon group having not greater than 18 carbon atoms. Examples thereof include a hydrocarbon group such as methyl group, ethyl group, n-propyl group, i-propyl group, allyl group, n-butyl group, sec-butyl group, t-butyl group, hexyl group, cyclohexyl group, benzyl group, phenyl group, tolyl group, t-butylphenyl group, naphthyl group, anthracenyl group and the like, and an optionally substituted hydrocarbon group such as 2-methoxyethyl group, fluorophenyl group, chlorophenyl group, bromophenyl group, iodophenyl group, methoxyphenyl group, hydroxyphenyl group, phenylthiophenyl group, hydroxynaphthyl group, methoxynaphthyl group, benzoylmethyl group, naphthoylmethyl group and the like.

$R^8$ and $R^9$ may be linked to each other to form a ring.

A cationic part of the onium salt represented by the general formulas (VI) to (VIII) includes an iodonium ion, sulfonium ion and diazonium ion. Examples of the structure of the cationic part of the onium salt are shown below but are not limited thereto.

(VI-a)

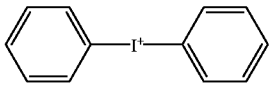

(VI-b)

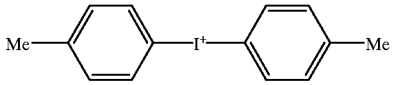

(VI-c)

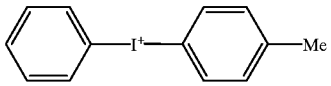

(VI-d)

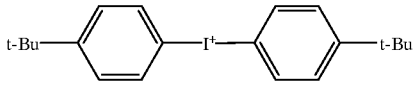

(VI-e)

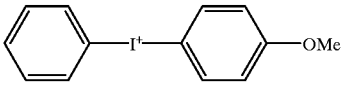

(VI-f)

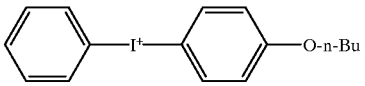

(VI-g)

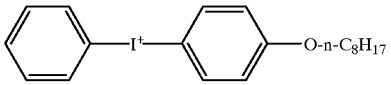

(VI-h)

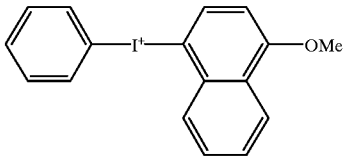

(VI-i)

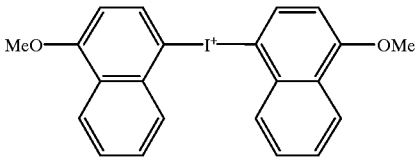

(VI-j)

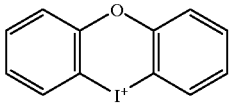

-continued
(VII-a)
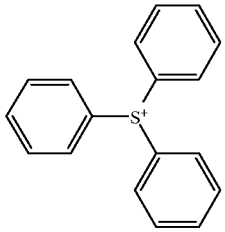
(VII-b)
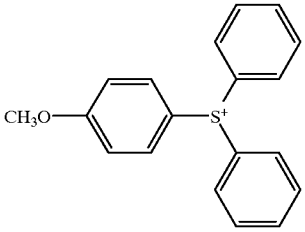
(VII-c)
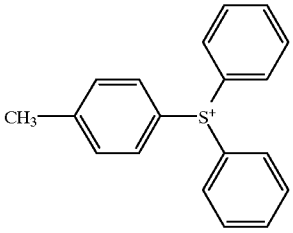
(VII-d)
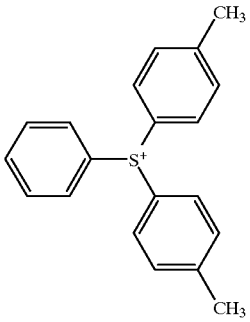
(VII-e)
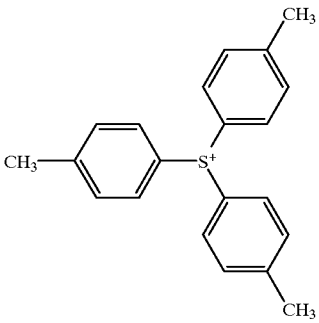
-continued
(VII-f)
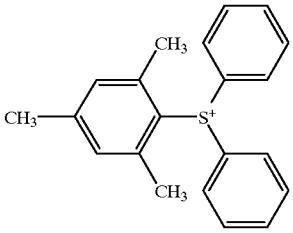
(VII-g)
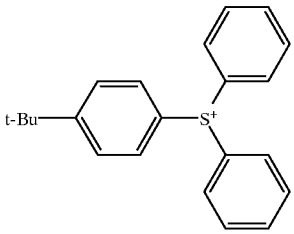
(VII-h)
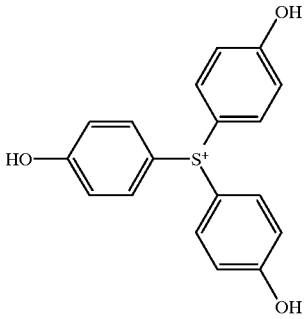
(VII-i)
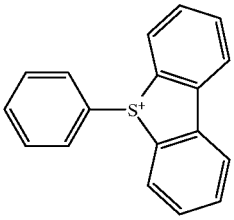
(VII-j)
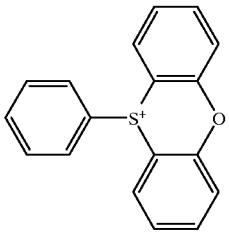
(VII-k)
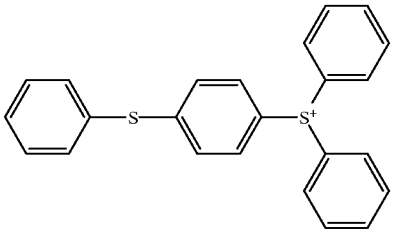

-continued
(VII-l)
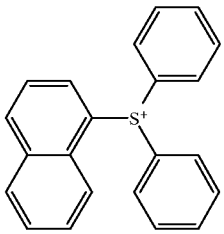
(VII-m)
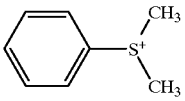
(VII-n)
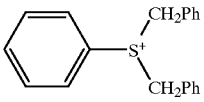
(VII-o)
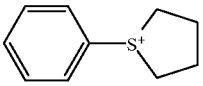
(VII-p)
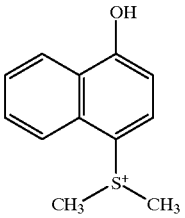
(VII-q)
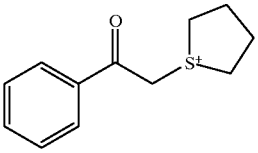
(VII-r)
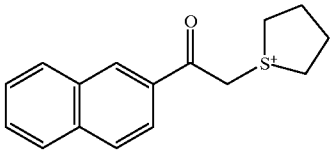
(VII-s)
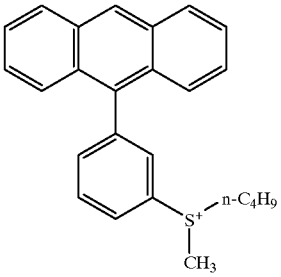
-continued
(VIII-a)
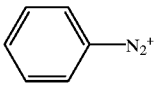
(VIII-b)
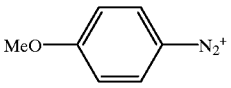
(VIII-c)
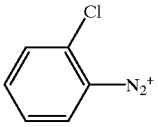
(VIII-d)
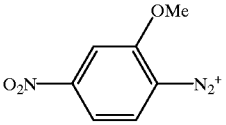
(VIII-e)
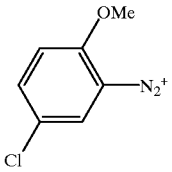
(VIII-f)
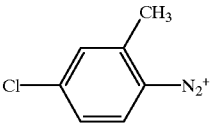
(VIII-g)
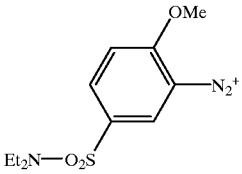
(VIII-h)
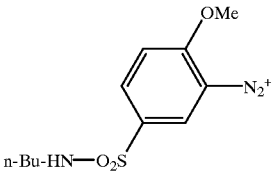
(VIII-i)
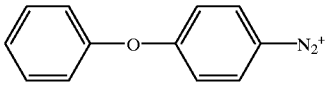
(VIII-j)
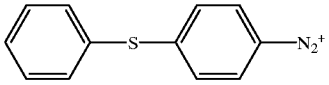

-continued (VIII-k)

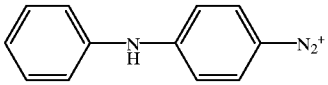

(VIII-l)

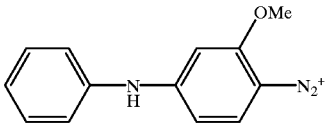

(VIII-m)

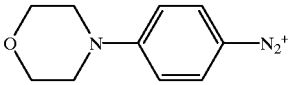

(VIII-n)

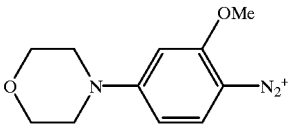

(VIII-o)

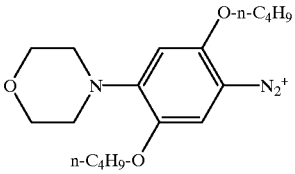

(VIII-p)

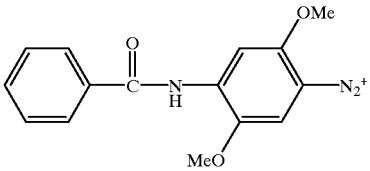

(VIII-q)

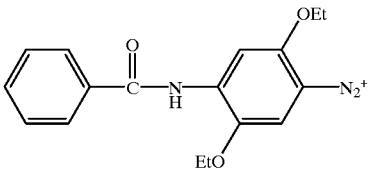

(VIII-r)

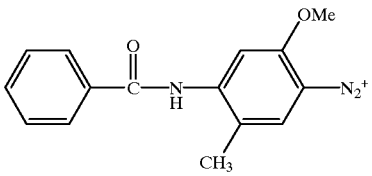

(VIII-s)

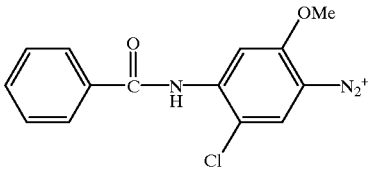

-continued (VIII-t)

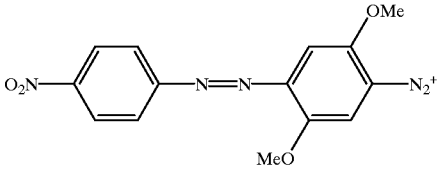

(VIII-u)

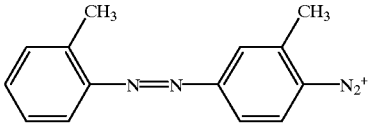

(VIII-v)

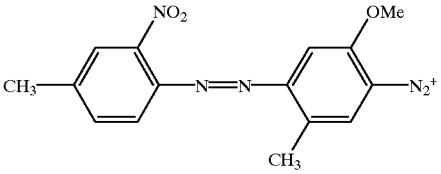

(VIII-w)

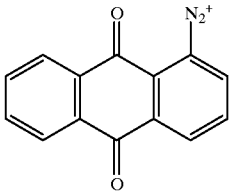

On the other hand, examples of sulfonate ions which are particularly preferably used as counter anions of these onium salts include:

1) methanesulfonate,
2) ethanesulfonate,
3) 1-propanesulfonate,
4) 2-propanesulfonate,
5) n-butanesulfonate,
6) allylsulfonate,
7) 10-camphorsulfonate,
8) trifluoromethanesulfonate,
9) pentafluoroethanesulfonate,
10) benzenesulfonate,
11) p-toluenesulfonate,
12) 3-methoxybenzenesulfonate,
13) 4-methoxybenzenesulfonate,
14) 4-hydroxybenzenesulfonate,
15) 4-chlorobenzenesulfonate,
16) 3-nitrobenzenesulfonate,
17) 4-nitrobenzenesulfonate,
18) 4-acetylbenzenesulfonate,
19) pentafluorobenzenesulfonate,
20) 4-dodecylbenzenesulfonate,
21) mesitylenesulfonate,
22) 2,4,6-triisopropylbenzenesulfonate,
23) 2-hydroxy-4-methoxybenzophenone-5-sulfonate,
24) isophthalic acid dimethyl-5-sulfonate,
25) diphenylamine-4-sulfonate,
26) 1-naphthalenesulfonate,
27) 2-naphthalenesulfonate,
28) 2-naphthol-6-sulfonate,
29) 2-naphthol-7-sulfonate,
30) anthraquinone-1-sulfonate,
31) anthraquinone-2-sulfonate, 32) 9,10-dimethoxyanthracene-2-sulfonate,
33) 9,10-diethoxyanthracene-2-sulfonate,
34) quinoline-8-sulfonate,
35) 8-hydroxyquinoline-5-sulfonate,
36) 8-anilino-naphthalene-1-sulfonate.

Further, salts of two equivalents of an onium salt cation and the following disulfonates can be used.

41) m-benzenedisulfonate,
42) benzaldehyde-2,4-disulfonate,
43) 1,5-naphthalenedisulfonate,
44) 2,6-naphthalenedisulfonate,
45) 2,7-naphthalenedisulfonate,
46) anthraquinone-1,5-disulfonate,
47) anthraquinone-1,8-disulfonate,
48) anthraquinone-2,6-disulfonate,
49) 9,10-dimethoxyanthracene-2,6-disulfonate,
50) 9,10-diethoxyanthracene-2,6-disulfonate Onium salt sulfonates which are suitably used in the present invention can be obtained by salt exchange by mixing the corresponding $Cl^-$ salt or the like with sulfonic acid, sodium sulfonate or potassium sulfonate in water or a mixed solvent of water and a hydrophilic solvent such as alcohol.

Synthesis of an onium compound can be performed through known methods, for example, methods described in Shin Jikkenkagakukoza volume 14-I, chapters 2 and 3 (p. 448), volume 14-III, chapters 8 and 16 (p. 1838), chapters 7 and 14 (p. 1564), published by Maruzen, J. W. Knapczyk et al., J. Am. Chem. Soc., volume 91, 145 (1969), A. L. Maycok et al., J. Org. Chem., volume 35, 2532 (1970), J. V. Crivello et al., Polym. Chem. Ed., volume 18, 2677 (1980), U.S. Pat. Nos. 2,807,648 and 4,247,473, Japanese Patent Application Laid-Open (JP-A) No. 53-101331, Japanese Patent Application Publication (JP-B) No. 5-53166.

Preferable examples of onium salt sulfonates which are suitably used as an acid generator in the present invention are shown below.

(VI-a-1)

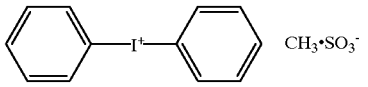

(VI-a-7)

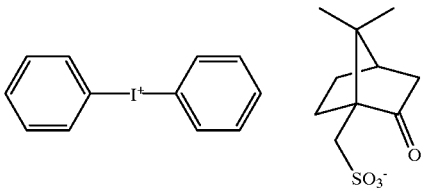

(VI-a-8)

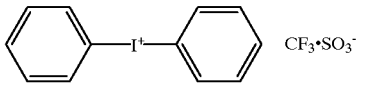

(VI-a-11)

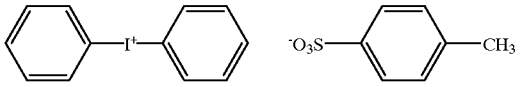

-continued (VI-a-13)

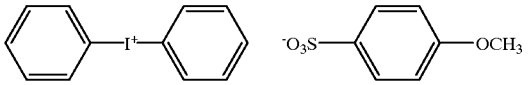

(VI-a-17)

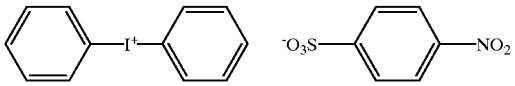

(VI-a-20)

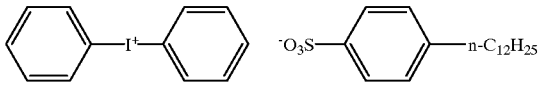

(VI-a-27)

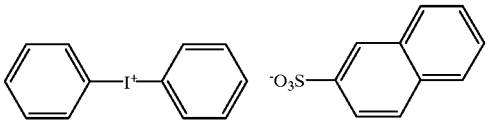

(VI-a-31)

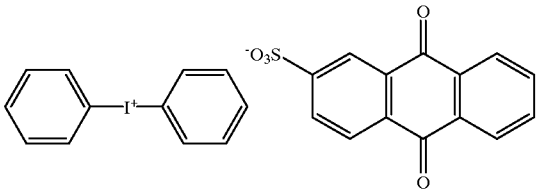

(VI-a-32)

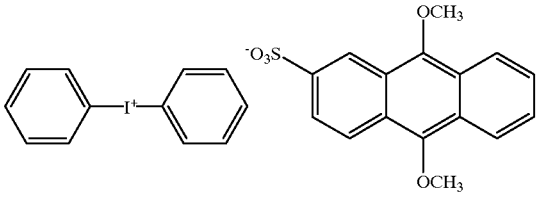

(VI-a-33)

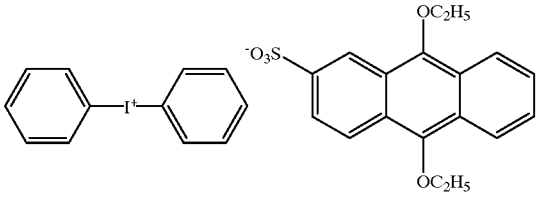

(VI-a-36)

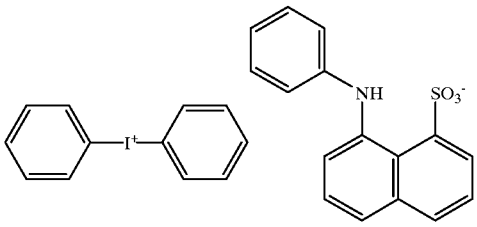

(VI-a-50)

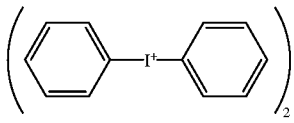

-continued
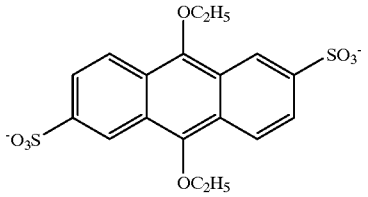
(VI-d-8)
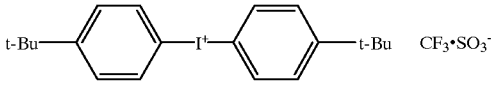
(VI-e-8)
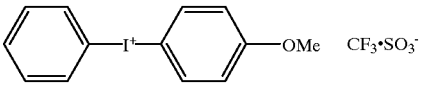
(IV-g-8)
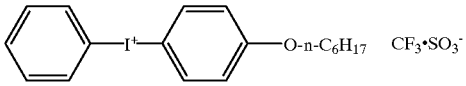
(VI-g-11)
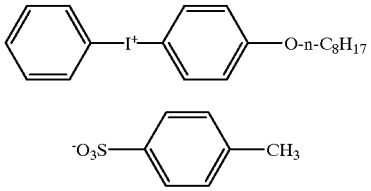
(VI-i-11)
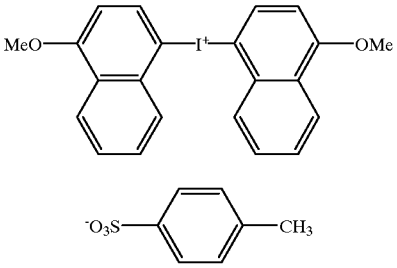
(VI-j-11)
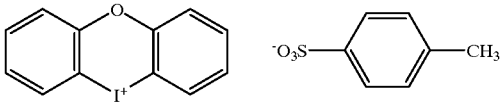
(VII-a-1)
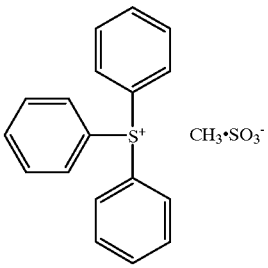
-continued
(VII-a-2)
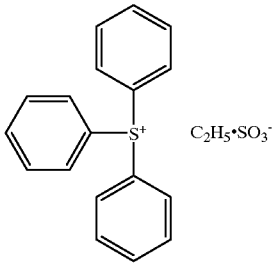
(VII-a-5)
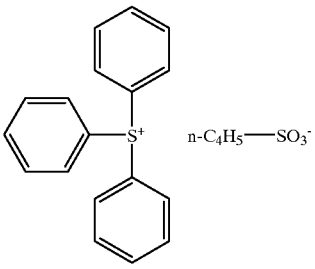
(VII-a-7)
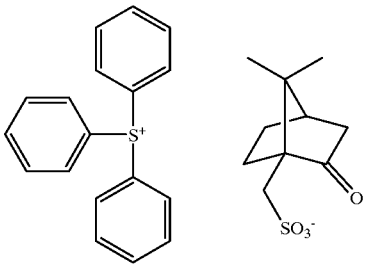
(VII-a-8)
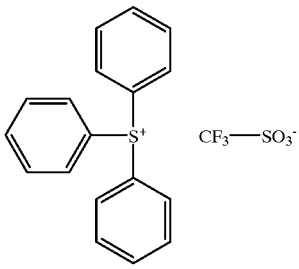
(VII-a-10)
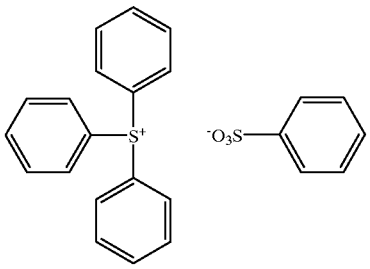

-continued
(VII-a-11)
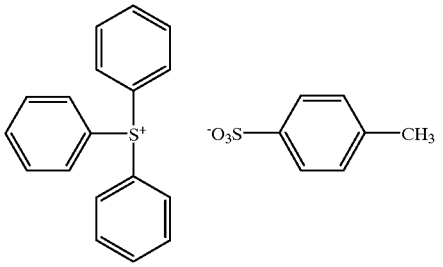
(VII-a-13)
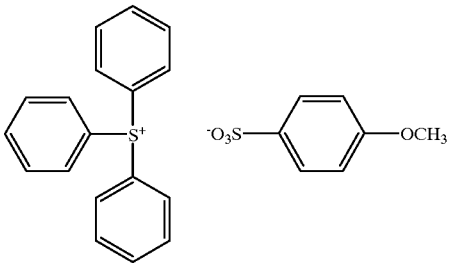
(VII-a-15)
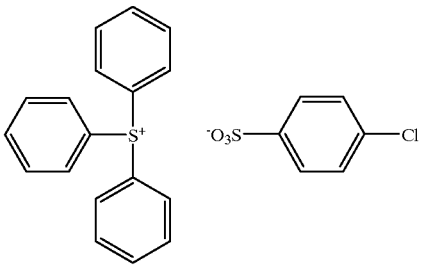
(VII-a-17)
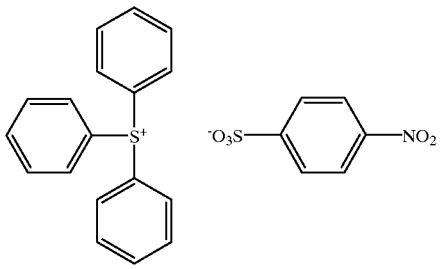
(VII-a-20)
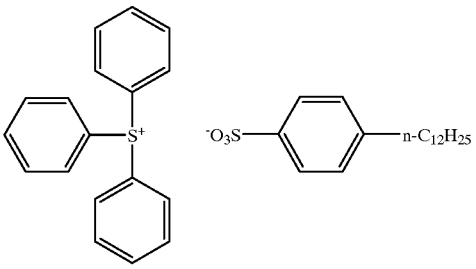
-continued
(VII-a-21)
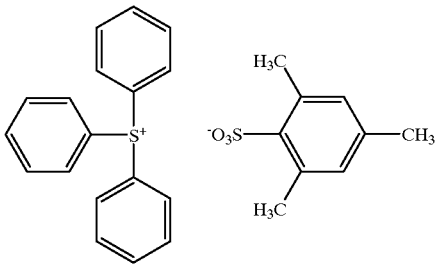
(VII-a-22)
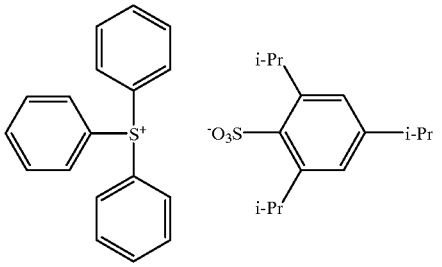
(VII-a-23)
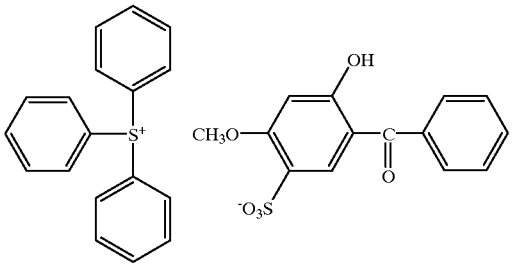
(VII-a-26)
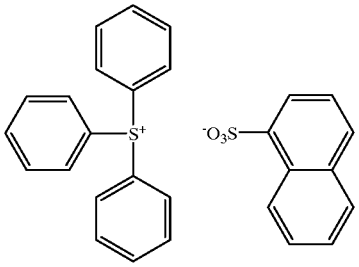
(VII-a-27)
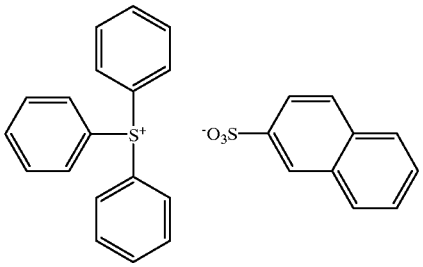

-continued
(VII-a-31)
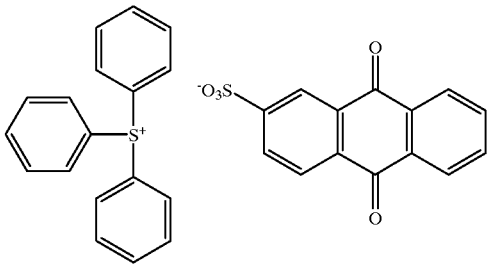
(VII-a-32)
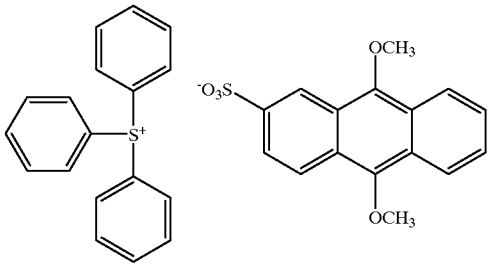
(VII-a-33)
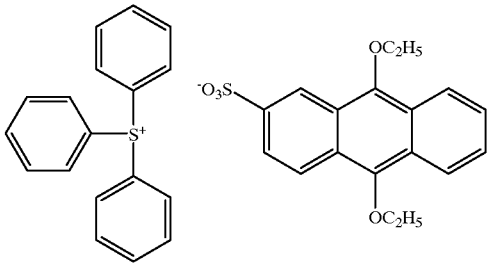
(VII-b-8)
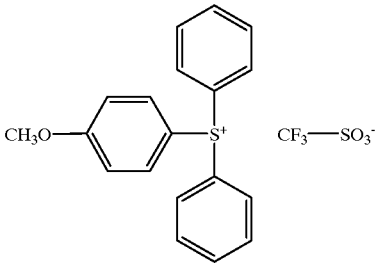
(VII-c-8)
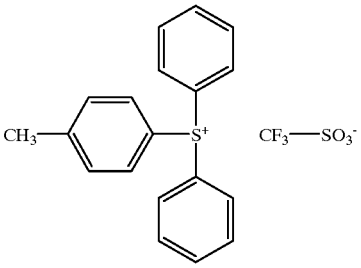
-continued
(VII-d-8)
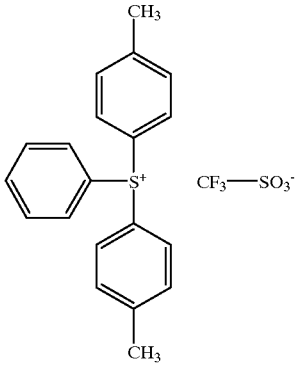
(VII-e-8)
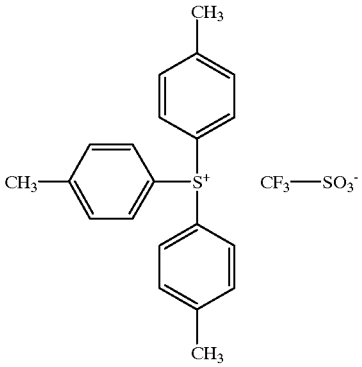
(VII-f-8)
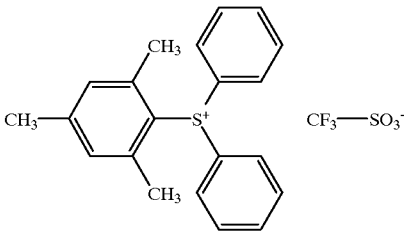
(VII-g-8)
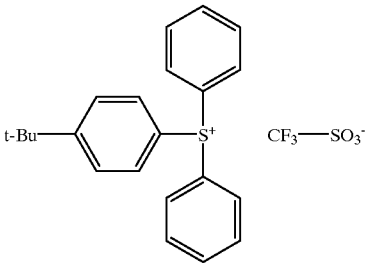

-continued
(VII-h-8)
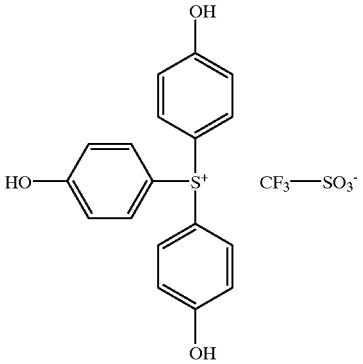
(VII-j-11)
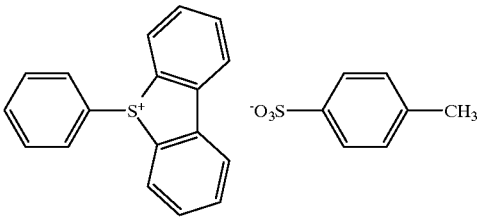
(VII-k-8)
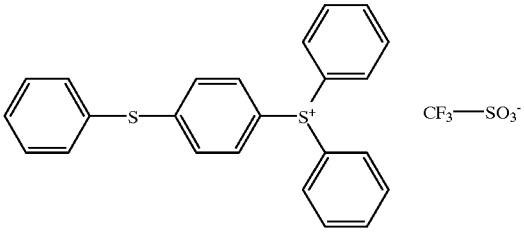
(VII-k-13)
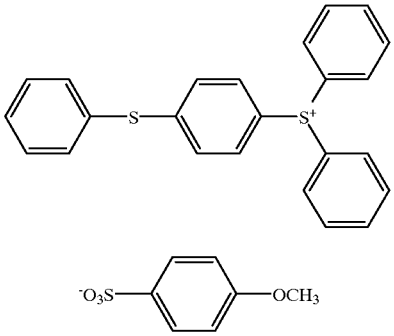
(VII-o-11)
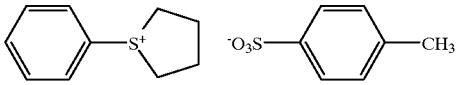
(VII-p-8)
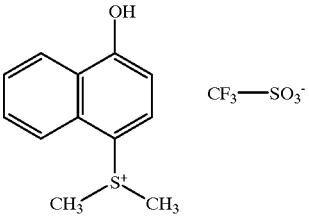
-continued
(VII-r-8)
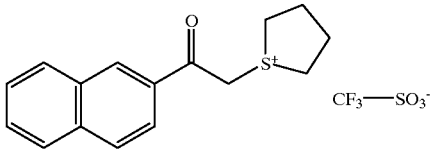
(VIII-b-20)
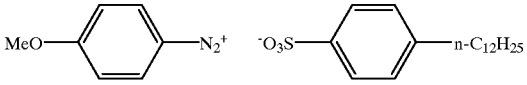
(VIII-c-20)
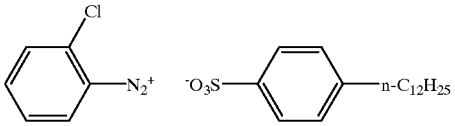
(VIII-d-21)
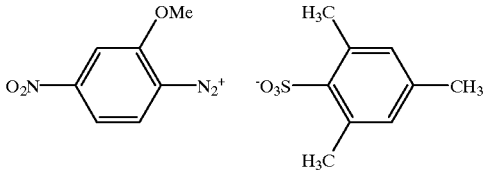
(VIII-e-21)
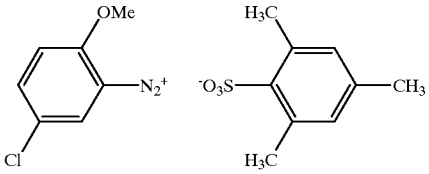
(VIII-k-20)
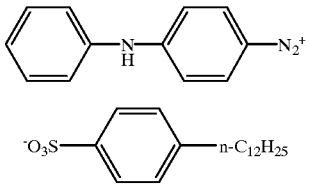
(VIII-k-21)
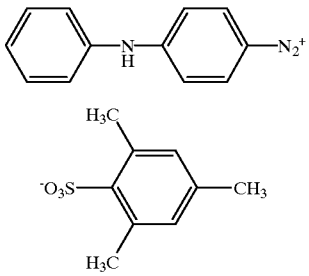
(VIII-l-21)
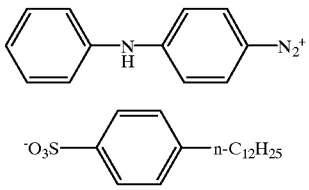

-continued (VIII-o-8)

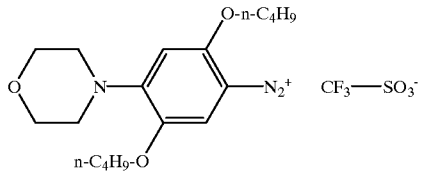

(VIII-p-21)

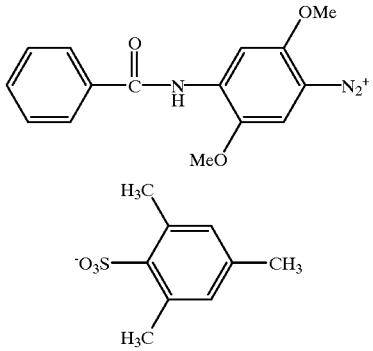

(VIII-t-20)

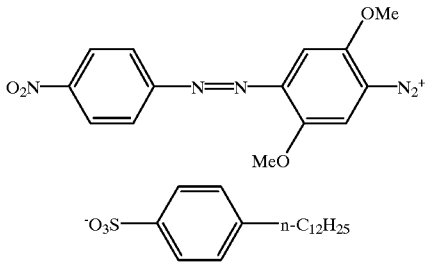

(VIII-w-21)

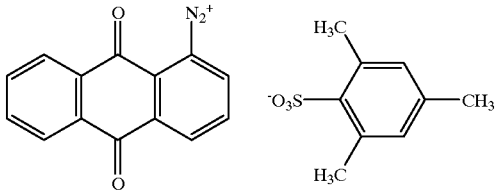

These acid generators are added to an image recording material in an amount of 0.01% to 50% by weight, preferably 0.1% to 25% by weight, more preferably 0.5% to 20% by weight based on the total solid components in the image recording layer of the image recording material. When the amount added is less than 0.01% by weight, an image can not be obtained and, when the amount added exceeds 50% by weight, staining occurs in non-image parts when printing. Accordingly, these ranges are not preferable.

These compounds may be used alone or in combination of two or more.

[Cross-linking agent (B) which is cross-linked in the presence of an acid]

In the present invention, as the cross-linking agent which is cross-linked in the presence of an acid (hereinafter, referred to as "cross-linking agent" for convenience), compounds comprising at least one phenol derivative, having a molecular weight not more than 200, which has two or more hydroxymethyl groups or alkoxymethyl groups which are bonded to a benzene ring, and has 3 to 5 benzene nuclei, in the molecule, are preferred. Examples thereof include a phenol derivative having two or more hydroxymethyl groups or alkoxymethyl groups which are bonded to the benzene ring in the molecule. An alkoxymethyl group having not greater than 6 carbon atoms is preferable. More particularly, a methoxymethyl group, ethoxymethyl group, n-propoxymethyl group, i-propoxymethyl group, n-butoxymethyl group, i-butoxymethyl group, sec-butoxymethyl group and t-butoxymethyl group are preferable.

In light of stability of the formed image, it is essential that the compounds contain 2, preferably 3, more preferably 4 or more hydroxymethyl groups or alkoxymethyl groups in the molecule. A compound having less than 2 of these groups is not preferable since an image is not easily formed. In addition, storability of a phenol derivative having an alkoxymethyl group at a high temperature is superior to that of a phenol derivative having a hydroxymethyl group. Accordingly, a phenol derivative having an alkoxymethyl group is preferable.

A phenol derivative having a molecular weight of 1,200 or more is not preferable in terms of storability.

Among these phenol derivatives, particularly preferable ones are shown below.

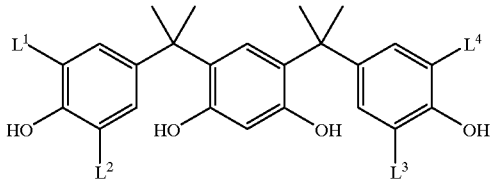

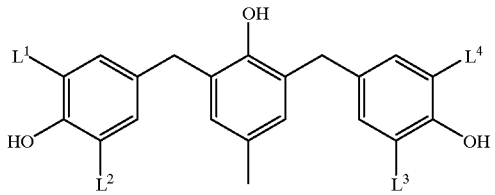

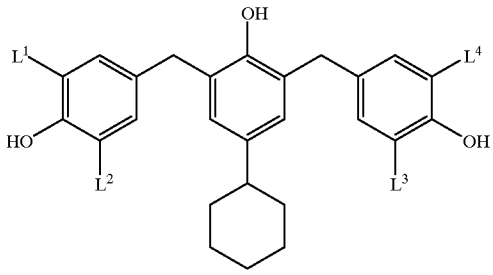

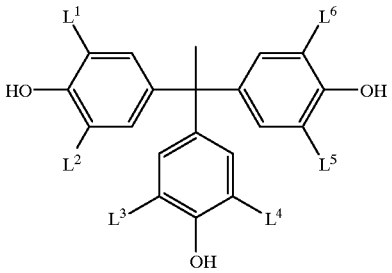

-continued
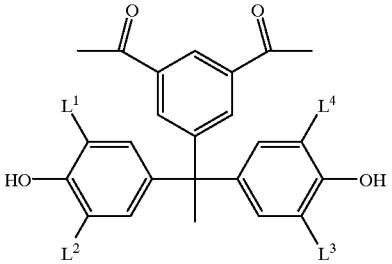
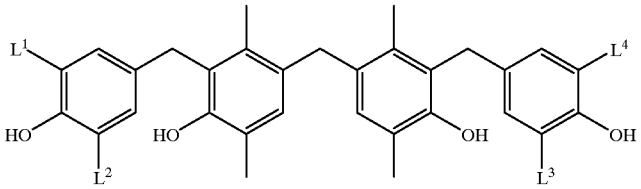
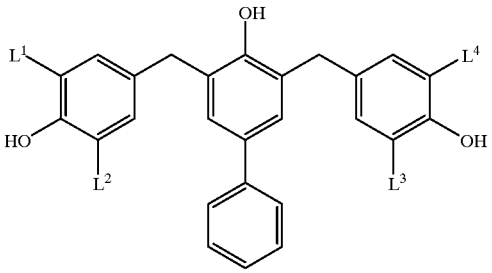
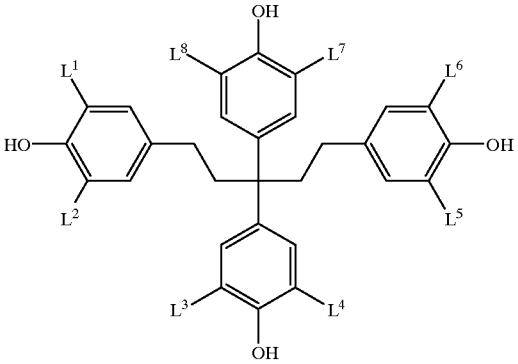
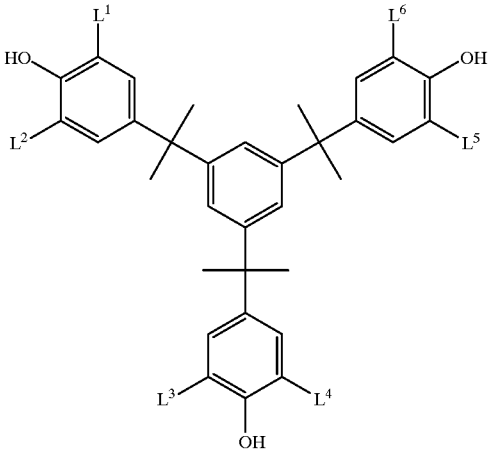
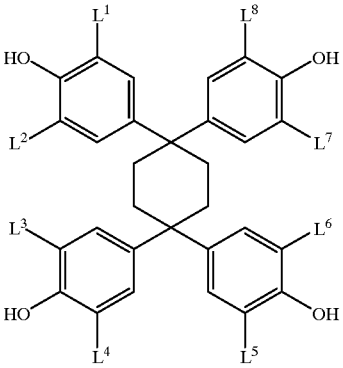
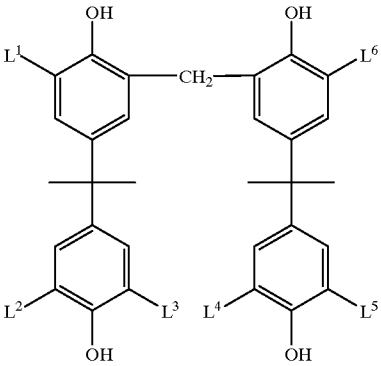
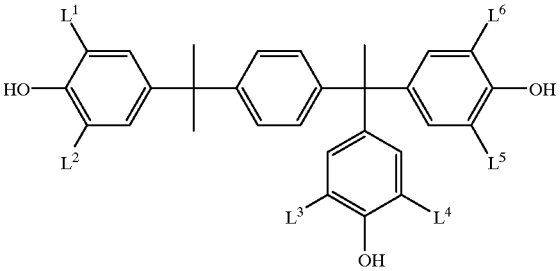

-continued
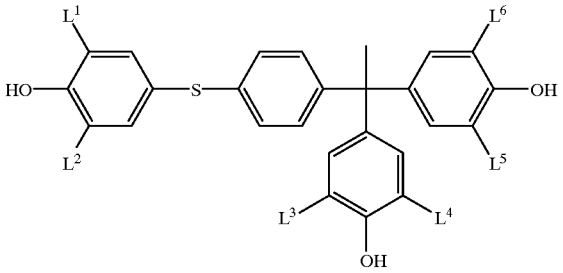
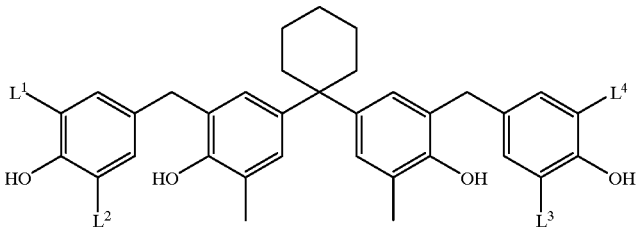
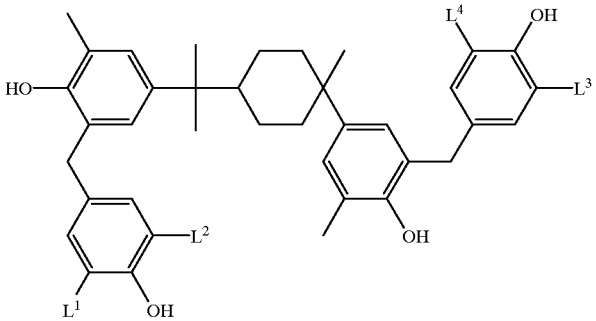
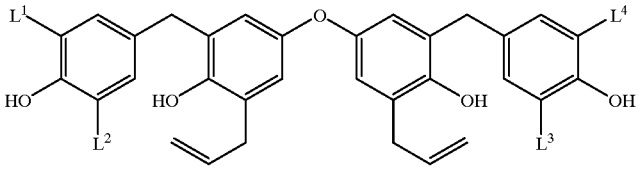
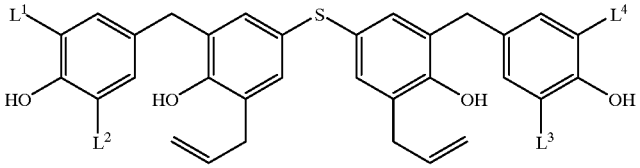
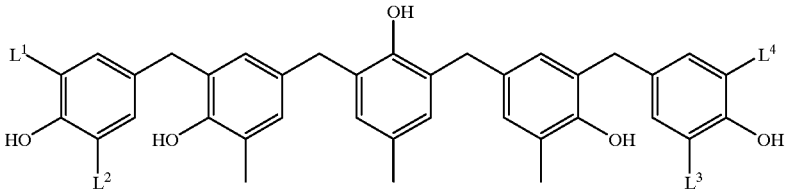

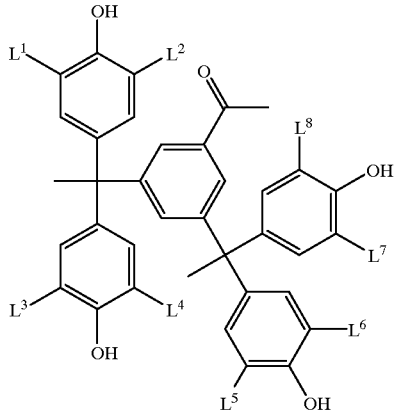

-continued

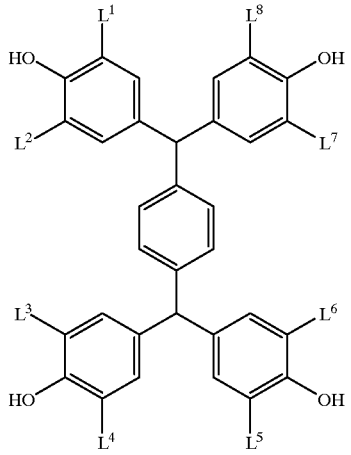

wherein $L^1$ to $L^8$ may be the same or different and each represents a hydroxymethyl group, methoxymethyl group, or ethoxymethyl group.

A phenol derivative having a hydroxymethyl group can be obtained by allowing to react a phenol compound having no corresponding hydroxymethyl group (compounds wherein $L^1$ to $L^8$ are hydrogen atoms in the above formulae) with formaldehyde in the presence of a basic catalyst. In this process, in order to prevent resinification and gelation, it is preferable that the reaction be carried out at a temperature of 60° C. or lower. More particularly, the phenol derivatives can be synthesized by the methods described in Japanese Patent Application Laid-Open (JP-A) Nos. 6-282067 and 7-64285 and the like.

Phenol derivatives having an alkoxymethyl group can be obtained by allowing to react a phenol derivative having a corresponding hydroxymethyl group with an alcohol in the presence of an acid catalyst. In this process, in order to prevent resinification and gelation, it is preferable that the reaction be carried out at a temperature of 100° C. or lower. More particularly, the phenol derivatives can be synthesized by the methods described in EP Patent No. 632003A1 and the like.

In the present invention, when a phenol derivative having a hydroxymethyl group or alkoxymethyl group is used as a cross-linking agent, the compound is used in an amount of 5% to 70% by weight, preferably 10% to 65% by weight, particularly preferably 15% to 60% by weight based on the total solid components in the image recording layer of the image recording material. When the added amount of the phenol derivative is less than 5% by weight, durability of a recording layer is deteriorated. The amount exceeding 70% by weight is not preferable from the viewpoint of stability during storage.

These phenol derivatives may be used alone or in a combination of two or more.

In addition, a resol resin may be preferably used as a cross-linking agent. The resol resin used in the present invention can be obtained by allowing to react a phenol having 6 to 20 carbon atoms with formaldehyde in the presence of a basic catalyst. More particularly, examples of phenols having 6 to 20 carbon atoms include phenol, cresol, xylenol, resorcinol, bisphenol A, tris(4-hydroxyphenyl) methane and the like. The phenol may singly be allowed to react with formaldehyde, or two or more phenols in combination may be allowed to react with formaldehyde. In this process, in order to prevent gelation, it is preferable that the reaction is carried out at a temperature of not higher than 100° C.

The resol resins used in the present invention preferably have an average weight molecular weight of 300–6000. When the average weight molecular weight exceeds 6000, it becomes easy to cause staining in non-image parts. The resol resin of the present invention is used in an amount of 5% to 80% by weight, preferably 10% to 70% by weight, particularly preferably 15% to 65% by weight in total solid components in the image recording layer of image recording material. When the amount of the resol resin is less than 5% by weight, a negative image is not formed. The amount exceeding 80% by weight is not preferable from the viewpoint of stability during storage.

These resol resins may be used alone or in a combination of two or more.

[Alkali-soluble Resin (C)]

The alkali-soluble resin used in the present invention includes a novolak resin, a polymer having a hydroxyaryl group on the side chain thereof and the like.

The novolak resin which may be used as an alkali-soluble resin in the present invention is a resin obtained by condensing phenols and aldehydes under acidic conditions.

Preferable novolak resins include a novolak resin obtained from phenol and formaldehyde, a novolak resin obtained from m-cresol and formaldehyde, anovolak resin obtained from p-cresol and formaldehyde, a novolak resin obtained from o-cresol and formaldehyde, a novolak resin obtained from octylphenol and formaldehyde, a novolak resin obtained from m-/p-mixed cresol and formaldehyde, a novolak resin obtained from a mixture of phenol/cresol (any of m-, p-, o- or m-/p-, m-/o-, o-/p-mixture may be used) and formaldehyde and the like.

These novolak resins have preferably a weight average weight molecular weight of 800~200,000 and a number average molecular weight of 400~60,000.

In addition, as the alkali-soluble resin in the present invention, a polymer having hydroxyaryl groups as the side chain thereof may preferably be used.

In this polymer, the hydroxyaryl group refers to an aryl group to which one or more —OH groups are bonded. Although a phenyl group, naphthyl group, anthracenyl group, phenanthrenyl and the like are exemplified as aryl groups, the phenyl group and naphthyl group are preferable in view of easy availability and physical properties. Therefore, as the hydroxyaryl group, a hydroxyphenyl group, dihydroxyphenyl group, trihydroxyphenyl group, tetrahydroxyphenyl group, hydroxynaphthyl group, dihydroxynaphthyl group and the like are preferable. These hydroxyaryl groups may further have a substituent such as a halogen atom, a hydrocarbon group having not greater than 20 carbon atoms, an alkoxy group having not greater than 20 carbon atoms, an aryloxy group having not greater than 20 carbon atoms and the like. These hydroxyaryl groups are bonded to the polymer main chain as pendant-like side chains and may have linking groups between the pendant-like side chain and the polymer main chain.

The polymers, having hydroxyaryl groups as the side chain, which are suitably used in the present invention are polymers having at least one structural unit represented by the following formulae (IX) to (XII).

(IX)

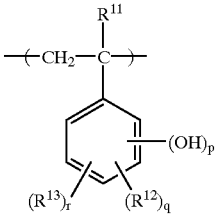

(X)

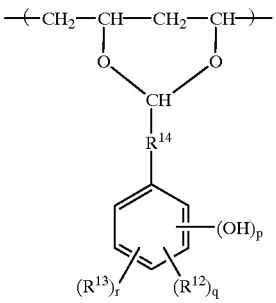

(XI)

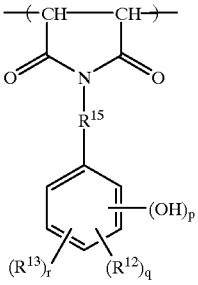

(XII)

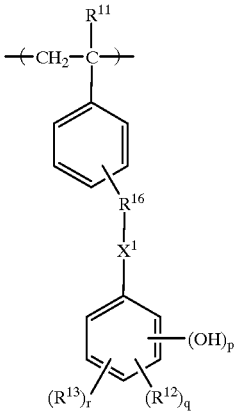

wherein $R^{11}$represents a hydrogen atom or a methyl group. $R^{12}$ and $R^{13}$ may be the same or different and each represents a hydrogen atom, a halogen atom, a hydrocarbon group having not greater than 10 carbon atoms, an alkoxy group having not greater than 10 carbon atoms or an aryloxy group having not greater than 10 carbon atoms. Further, $R^{12}$ and $R^{13}$ may be linked to each other to form a condensed benzene ring or a cyclohexane ring. $R^{14}$ represents a single bond or a divalent hydrocarbon group having not greater than 20 carbon atoms. $R^{15}$ represents a single bond or a divalent hydrocarbon group having not greater than 20 carbon atoms. $R^{16}$ represents a single bond or a divalent hydrocarbon group having not greater than 10 carbon atoms. X1 represents a single bond, an ether bond, a thioether bond, an ester bond or an amine bond. p represents an integer of 1 to 4. q and r each represents an integer of 0 to 3, respectively.

Among the structural units represented by the general formulae (IX) to (XII), examples of particular structural units which are suitably used in the present invention are shown below.

(IX-1)

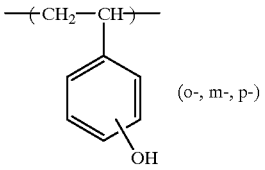

(IX-2)

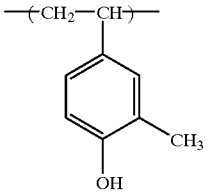

(IX-3)

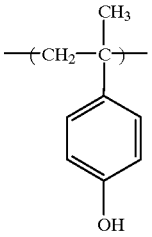

(IX-4)

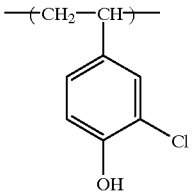

(X-1)

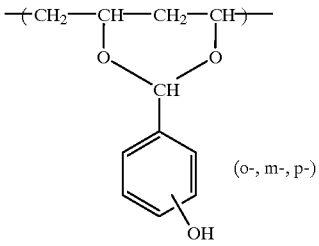

-continued
(X-2)
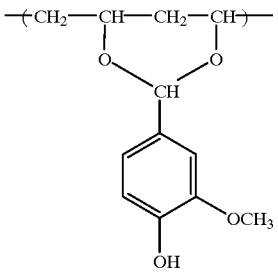
(X-3)
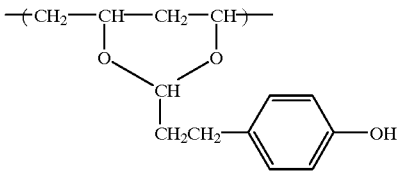
(X-4)
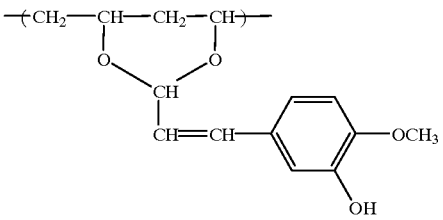
(X-5)
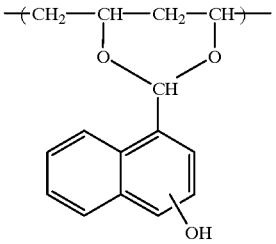
(XII-1)
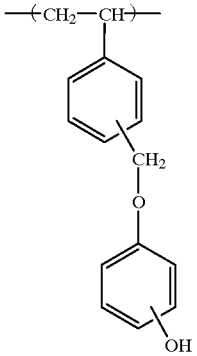
-continued
(XII-2)
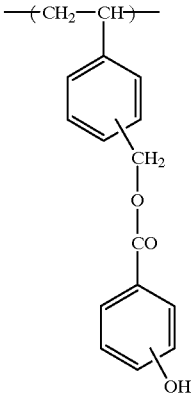
(XII-3)
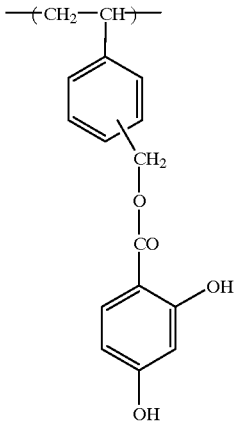
(XII-4)
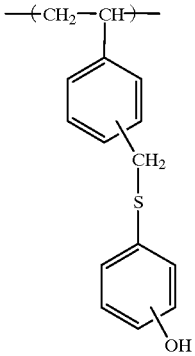
(XII-5)
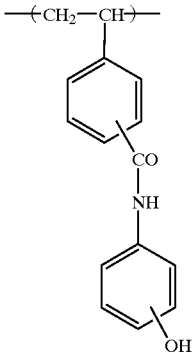

-continued (XII-6)

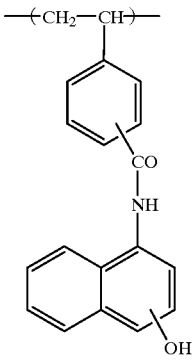

These polymers can be synthesized according to known methods.

For example, a polymer having the structural unit represented by the general formula (IX) can be obtained by radical polymerization or anion polymerization of the corresponding styrene derivative in which a hydroxy group is protected as an acetic ester or t-butyl ether to from a polymer, followed by deprotection.

A polymer having the structural unit represented by the general formula (X) can be synthesized by the methods described in Japanese Patent Application Laid-Open (JP-A) Nos. 64-32256 and 64-35436.

Further, a polymer having the structural unit represented by the general formula (XI) can be obtained by allowing to react an amine compound having a hydroxy group with maleic anhydride to obtain the corresponding monomer, followed by radically polymerizing the monomer to form a polymer.

In addition, a polymer having the structural unit represented by the general formula (XII) can be obtained using styrene derinatives, as starting materials, having a synthetically useful functional group such as chloromethylstyrene and carboxystyrene into monomers corresponding to the general formula (XII), followed by radically polymerizing the monomer to form polymers.

In the present invention, homopolymers composed of only the structural unit represented by the general formulae (IX) to (XII) may be used or copolymers containing other structural units may also be used.

Examples of other structural units which are suitably used include structural units derived from known monomers such as acrylic esters, methacrylic esters, acrylamides, methacrylamides, vinyl esters, styrenes, acrylic acid, methacrylic acid, acrylonitrile, maleic anhydride, maleic imide and the like.

Examples of the acrylic esters which may be used include methyl acrylate, ethyl acrylate, (n- or i-)propyl acrylate, (n-, i-, sec- or t-)butyl acrylate, amyl acrylate, 2-ethylhexyl acrylate, dodecyl acrylate, chloroethyl acrylate, 2-hydroxyethyl acrylate, 2-hydroxypropyl acrylate, 5-hydroxyp-entyl acrylate, cyclohexyl acrylate, allyl acrylate, trimet-hylolpropane monoacrylate, pentaerythritol monoacrylate, glycidyl acrylate, benzyl acrylate, methoxybenzyl acrylate, chlorobenzyl acrylate, 2-(p-hydroxyphenyl) ethyl acrylate, furfuryl acrylate, tetrahydrofurfuryl acrylate, phenyl acrylate, chlorophenyl acrylate, sulfamoylphenyl acrylate and the like.

Examples of the methacrylic esters include methyl methacrylate, ethyl methacrylate, (n- or i-)propyl methacrylate, (n-, i-, sec- or t-)butyl methacrylate, amyl methacrylate, 2-ethylhexyl methacrylate, dodecyl methacrylate, chloroethyl methacrylate, 2-hydroxyethyl methacrylate, 2-hydroxypropyl methacrylate, 5-hydroxypentyl methacrylate, cyclohexyl methacrylate, allyl methacrylate, trimethylolpropane monomethacrylate, pentaerythritol monomethacrylate, glycidyl methacrylate, methoxybenzyl methacrylate, chlorobenzyl methacrylate, 2-(p-hydroxyphenyl)ethyl methacrylate, furfuryl methacrylate, tetrahydrofurfuryl methacrylate, phenyl methacrylate, chlorophenyl methacrylate, sulfamoylphenyl methacrylate and the like.

Examples of the acrylamides include acrylamide, N-methylacrylamide, N-ethylacrylamide, N-propylacrylamide, N-butylacrylamide, N-benzylacrylamide, N-hydroxyethylacrylamide, N-phenylacrylamide, N-tolylacrylamide, N-(p-hydroxyphenyl)acrylamide, N-(sulfamoylphenyl) acrylamide, N-(phenylsulfonyl)acrylamide, N-(tolylsulfonyl)acrylamide, N,N-dimethylacrylamide, N-methyl-N-phenylacrylamide, N-hydroxyethyl-N-methylacrylamide and the like.

Examples of the methacrylamides include methacrylamide, N-methylmethacrylamide, N-ethylmethacrylamide, N-propylmethacrylamide, N-butylmethacrylamide, N-benzylmethacrylamide, N-hydroxyethylmethacrylamide, N-phenylmethacrylamide, N-tolylmethacrylamide, N-(p-hydroxyphenyl) methacrylamide, N-(sulfamoylphenyl)methacrylamide, N-(phenylsulfonyl)methacrylamide, N-(tolylsulfonyl) methacrylamide, N,N-dimethylmethacrylamide, N-methyl-N-phenylmethacrylamide, N-hydroxyethyl-N-methylmethacrylamide and the like.

Examples of the vinyl esters include vinyl acetate, vinyl butyrate, vinyl benzoate and the like.

Examples of the styrenes include styrene, methylstyrene, dimethylstyrene, trimethylstyrene, ethylstyene, propylstyrene, cyclohexylstyrene, chloromethylstyrene, trifluoromethylstyrene, ethoxymethylstyrene, acetoxymethylstyene, methoxystyrene, dimethoxystyrene, chlorostyrene, dichlorostyrene, bromostyrene, iodostyrene, fluorostyrene, carboxystyrene and the like.

Among these monomers, acrylic esters, methacrylic esters, acrylamides, methacrylamides, vinyl esters, styrenes, acrylic acid, methacrylic acid and acrylonitrile having not greater than 20 carbon atoms, are particularly preferably used.

The proportion of the structural units represented by the general formulae (I) to (IV) is preferably 5% to 100% by weight, more preferably 10% to 100% by weight in the copolymers using the above monomers.

The molecular weight of the polymers used in the present invention is preferably not less than 4,000, more preferably in the range of 10,000 to 300,000 in terms of weight average molecular weight and, preferably not less than 1,000, more preferably in the range of 2,000 to 250,000 in terms of number average molecular weight. Polydispersion degree (weight average molecular weight/number average molecular weight) is preferably not less than 1, more preferably in the range of 1.1 to 10.

These polymers may be any of a random polymer, a block polymer and a graft polymer and the like, but the random polymer is preferable.

The alkali-soluble resins used in the present invention may be used alone, or they may be used in combination of two or more ones. The amount of the alkali-soluble resin to be added is 5% to 95% by weight, preferably 10% to 95% by weight, particularly preferably 20% to 90% by weight in total solid component of the image recording layer of the image recording material. When the amount of the alkali-soluble resin is less than 5% by weight, durability of a recording layer is deteriorated and, when the amount exceeds 95% weight, no image is formed.

[Infrared absorbing agent (D)]

The infrared absorbing agent used in the present invention is a dye or a pigment which effectively absorbs infrared-rays having wavelengths of 760 nm to 1200 nm. A dye or a pigment which has an absorption maximum at a wavelength of 760 nm to 1200 nm is preferable.

As the dye, known dyes which are commercially available or are described in the literature (for example, "Senryobinran (Dye Handbook)" edited by Yukigoseikagaku Kyokai, published in 1970) may be utilized. More particularly, dyes such as an azo dye, a metal complex azo dye, a pyrazolone azo dye, a naphthoquinone dye, an anthraquinone dye, a phthalocyanine dye, a carbonium dye, a quinoneimine dye, a methine dye, a cyanine dye, a squarylium dye, a pyrylium salt, a metal thiolate complex and the like are exemplified.

Preferable dyes include cyanine dyes described in Japanese Patent Application Laid-Open (JP-A) Nos. 58-125246, 59-84356, 59-202829, 60-78787 and the like, methine dyes described in Japanese Patent Application Laid-Open (JP-A) Nos. 58-173696, 58-181690, 58-194595 and the like, naphthoquinone dyes described in Japanese Patent Application Laid-Open (JP-A) Nos. 58-112793, 58-224793, 59-48187, 59-73996, 60-52940, 60-63744 and the like, squarylium dyes described in Japanese Patent Application Laid-Open (JP-A) No. 58-112792 and the like, cyanine dyes described in GB 434,875 and the like.

In addition, near infrared absorbing sensitizers described in U.S. Pat. No. 5,156,938 are suitably used. A substituted arylbenzo(thio)pyrylium salt described in U.S. Pat. No. 3,881,924, trimethinethiapyrylium salt described in Japanese Patent Application Laid-Open (JP-A) No. 57-142645 (U.S. Pat. No. 4,327,169), pyrylium compounds described in Japanese Patent Application Laid-Open (JP-A) Nos. 58-181051, 58-220143, 59-41363, 59-84248, 59-84249, 59-146063, and 59-146061, a cyanine dye described in Japanese Patent Application Laid-Open (JP-A) No. 59-216146, a pentamethinethiopyrylium salt described in U.S. Pat. No. 4,283,475, and the like, pyrylium compounds described in Japanese Patent Application Publication (JP-B) Nos. 5-13514 and 5-19702 are also preferably used.

Further, other examples of preferable dyes are near-infrared absorbing dyes which are represented by the formulae (I) and (II) described in U.S. Pat. No. 4,756,993.

Among these dyes, particularly preferable dyes are cyanine dyes, squarylium dyes, pyrylium salts, and nickel thiolate complexes.

As the pigments used in the present invention, commercially available pigments and pigments described in Color Index (C.I.) Handbook, "Saishin Ganryo Binran (Modern Pigment Handbook)" (Edited. by Nihon Ganryo Gijutsu Kyokai, published in 1977), "Saishin Ganryo Oyo Gijutsu (Modern Pigment Application Technology)" (CMC Publishing Co., published in 1986), "Insatsuink Gijutsu (Printing Ink technology)" (CMC Publishing Co., published in 1984) may be utilized.

Examples of the pigments are a black pigment, a yellow pigment, an orange pigment, a brown pigment, a red pigment, a purple pigment, a blue pigment, a green pigment, a fluorescent pigment, a metal powder pigment, and polymer-bonded-pigment. More particularly, an insoluble azo pigment, an azo lake pigment, a condensed azo pigment, a chelate azo pigment, a phthalocyanine pigment, an anthraquinone pigment, perylene and perynone pigments, a thioindigo pigment, a quinacridone pigment, a dioxazine pigment, an isoindolinone pigment, a quinophthalone pigment, in-mold decorating lake pigment, an azine pigment, a nitroso pigment, a nitro pigment, a natural pigment, a fluorescent pigment, an inorganic pigment, carbon black and the like. Among these pigments, carbon black is preferable.

These pigments may be used without surface treatment, or they may be used after surface treatment. Surface treating methods include a method of coating a resin or wax on the surface of pigments, a method of adhering a surfactant to the surface of pigments, a method of bonding a reactive substance (such as a silane coupling agent, epoxy compound, polyisocyanate and the like) to the surface of pigments. The above surface treating methods are described in "Kinzoku Sekken no Seishitsu to Oyo (Natures and Applications of Metal Soaps)", Saiwai Publishing Co., "Insatsuink Gijutsu (Printing Ink Technology)", CMC Publishing Co., published in 1984; and "Saishin Ganryo Oyo Gijutsu (Modern Pigment Application Technology)", CMC Publishing Co., published in 1986.

The particle size of the pigment is preferably in the range of 0.01 $\mu$m to 10 $\mu$m, more preferably in the range of 0.05 $\mu$m to 1 $\mu$m, particularly preferably in the range of 0.1 $\mu$m to 1 $\mu$m. The particle size of the pigment of less than 0.01 $\mu$m is not preferable in light of stability of the pigment dispersion in a coating solution for photo-sensitive layer. The particle size exceeding 10 $\mu$m is not preferable in light of the uniformity of an image recording layer.

As a method of dispersing a pigment, known methods used for preparing an ink or toner may be employed. Examples of a dispersing machine are an ultrasonic dispersing machine, sand mill, attritor, pearl mill, super mill, ball mill, impeller, disperser, KD mill, colloid mill, dynatron, triple roll mill, pressure kneader and the like. Details thereof are described in "Saishin Ganryo Oyo Gijutsu (Modern Pigment Application Technology)", CMC Publishing Co., published in 1986.

These dyes or pigments may be added in the image recording material in an amount of 0.01% to 50% by weight, preferably 0.1% to 10% by weight, particularly preferably 0.5% to 10% by weight in the case of dyes, and particularly preferably 1.0% to 10% by weight in the case of pigments, based on the total weight of solid components in the image recording layer of the image recording material. When the amount of pigment or dye is less than 0.01% by weight, the sensitivity is reduced. When the amount exceeds 50% by weight, stains are formed in non-image parts upon printing.

These dyes or pigments may be added in the same layer as that containing other components or they may be added in a separate layer.

[Other Components]

In the present invention, the above five components are essential. However, various compounds may be added thereto, if necessary.

For example, a dye having a high absorption in the visible light region may be used as a coloring agent for an image.

More particularly, the coloring agent includes Oil Yellow #101, Oil Yellow #103, Oil Pink #312, Oil Green BG, Oil Blue BOS, Oil Blue #603, Oil Black BY, Oil Black BS and Oil Black T-505 (manufactured by Orient Kagakukogyo K.K.), Victoria Pure Blue, Crystal Violet (CI42555), Methyl Violet (CI42535), Ethyl Violet, Rhodamine B (CI145170B), Malachite Green (CI42000), Methylene Blue (CI52015), and the like, as well as dyes described in Japanese Patent Application Laid-Open (JP-A) No. 62-293247.

Since these dyes facilitate the differentiation between an image area and a non-image area after image formation, they are preferably added. The amount to be added is 0.01% to 10% by weight based on the total weight of solid components in the image recording layer of the image recording material.

In order to improve processing stability to variations of development processing conditions, nonionic surfactants described in Japanese Patent Application Laid-Open (JP-A) Nos. 62-251740 and 3-208514, amphoteric surfactants described in Japanese Patent Application Laid-Open (JP-A) Nos. 59-121044 and 4-13149 may be added to the present image recording material.

Examples of nonionic surfactants are sorbitan tristearate, sorbitan monopalmitate, sorbitan trioleate, stearic acid monoglyceride, polyoxyethylene nonyl phenyl ether and the like.

Examples of amphoteric surfactants are alkyldi(aminoethyl)glycine, alkylpolyaminoethylglycine hydrochloride, 2-alkyl-N-carboxyethyl-N-hydroxyethylimidazolinium betaine and N-tetradecyl-N,N-betaine type amphoteric surfactant (for example, trade name; Amogen K, manufactured by Daiichikogyo K.K.), and the like. The amount of the above nonionic surfactant and amphoteric surfactant in the image recording material is preferably0.05% to 15% by weight, more preferably 0.1% to 5% by weight.

A plasticizer may be added to the present image recording material, if necessary, in order to impart flexibility to the coating layer. For example, polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl an oleate, an oligomer and a polymer of acrylic acid or methacrylic acid and the like are used.

In addition to these, epoxy compounds, vinyl ethers or the like may be added therein.

The image recording material of the present invention can be prepared by dissolving respective components in a solvent and coating the resultant solution on an appropriate support. Examples of the solvents are not limited to specified ones but include ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethylacetamide, N,N-dimethylformamide, tetramethylurea, N-methylpyrrolidone, dimethyl sulfoxide, sulfolane, γ-butyllactone, toluene, water and the like. These solvents are used alone or in admixture thereof. The concentration of the above components (total solid components including additives) in the solvent is preferably 1% to 50% by weight. The coating amount (solid content) on a support after coating and drying depends on the type of application and is preferably 0.5% to 5.0 g/m$^2$, in general, for a planographic printing plate. Various coating methods may be used, such as bar coater coating, spin coating, spray coating, curtain coating, dip coating, air knife coating, blade coating, roll coating and the like. As the coated amount becomes smaller, the apparent sensitivity becomes higher, but the coating properties of the image recording layer deteriorates.

A surfactant for improving the coating properties, for example, a fluorosurfactant described in Japanese Patent Application Laid-Open (JP-A) No. 62-170950 may be added to the image recording layer. An amount to be added is preferably 0.01% to 1% by weight, more preferably 0.05% to 0.5% by weight based on total weight of solid components in the image recording layer of the image recording material.

A support used in the present invention is a dimensionally-stable plate-like material. Examples thereof include paper, paper laminated with plastic (such as polyethylene, polypropylene, polystyrene and the like), a metal plate (such as aluminum, zinc, copper and the like), a plastic film (such as cellulose diacetate, cellulose triacetate, cellulose propionate, cellulose butyrate, cellulose acetate butyrate, cellulose nitrate, polyethyleneterephthalate, polyethylene, polystyrene, polypropylene, polycarbonate, polyvinyl acetal and the like), paper or a plastic film laminated or deposited with any one of the above metals.

A polyester film and an aluminum plate are preferable as a support in the present invention. Among them, an aluminum plate is particularly preferable because of its dimensional stability and low cost. Suitable aluminum plate is a pure aluminum plate and an alloy plate having aluminum as a main component and containing trace quantities of other elements. A plastic film laminated or deposited with aluminum may be used. Examples of the other elements contained in the aluminum alloy are silicon, iron, manganese, copper, magnesium, chromium, zinc, bismuth, nickel, titanium and the like. Content of the other elements in the alloy is at most 10% by weight. Particularly suitable aluminum is pure aluminum. However, since it is difficult to manufacture completely pure aluminum in view of refining techniques, trace quantities of other elements may be contained. As mentioned above, components of aluminum plate used in the present invention are not limited to specific ones. Aluminum plates which have been previously known and used can be arbitrarily used. The thickness of the aluminum plate used in the present invention is approximately 0.1 mm to 0.6 mm, preferably 0.15 mm to 0.4 mm, particularly preferably 0.2 mm to 0.3 mm.

Prior to roughening of the surface of an aluminum plate, a degreasing treatment is carried out using a surfactant, an organic solvent, an aqueous alkaline solution or the like in order to remove rolling oil from the surface of the aluminum plate, if necessary.

Roughening of the surface of the aluminum plate is carried out by various methods, for example, by a method using mechanical roughening, a roughening method of electrochemically dissolving the surface or a method of selectively dissolving the surface chemically. As a mechanical method, known methods such as ball abrasion, brush abrasion, blast abrasion, buff abrasion and the like may be used. An electrochemical roughening method includes a method using alternating or direct current in a hydrochloric acid or nitric acid electrolysis solution. Alternatively, both methods can be performed through a combination thereof as disclosed in Japanese Patent Application Laid-Open (JP-A) No. 54-63902.

The aluminum plate thus roughened is subjected to an alkali etching treatment and neutralization treatment, if necessary and, thereafter, to anodization in order to enhance the water retention characteristics and abrasion resistance, as occasion demands. As electrolytes for anodizing the aluminum plate, various electrolytes which form a porous oxide layer can be employed. In general, sulfuric acid, phosphoric acid, oxalic acid, chromic acid or a mixed acid thereof are used. The concentration of the electrolyte is appropriately selected depending upon the kind of the electrolyte.

Conditions for anodizing treatment are not limited to specified ones since they vary with the kind of the electrolyte. Suitable conditions are in the range of concentration of the electrolyte of 1% to 80% by weight, temperature of the solution of 5° C. to 70° C., current density of 5 to 60A/dm$^2$, voltage of 1 V to 100 V and an electrolysis time of 10 seconds to 5 minutes.

When an amount of an anodized oxide layer is less than 1.0 g/m$^2$, the plate wear is insufficient and scratches are easily produced in a non-image part of the planographic printing plate and, thereby, so-called "tinting due to scratches" is easily produced.

After the anodizing treatment, the surface of the aluminum plate is subjected to a process for imparting hydrophilicity thereto, if necessary. An example of such treatments includes a method using alkaline metal silicate (for example, aqueous solution of sodium silicate) as disclosed in U.S. Pat. Nos. 2,714,066, 3,181,461, 3,280,734 and 3,902,734. In this method, a support is treated by immersing in an aqueous solution of sodium silicate or treated through electrolysis. Other methods include a method of treatment of a support with potassium fluorozirconate as disclosed in Japanese Patent Application Publication (JP-B) No. 36-22063 or with polyvinylphosphonic acid as disclosed in U.S. Pat. Nos. 3,276,868, 4,153,461 and 4,689,272.

In the image recording material of the present invention, a subbing layer may be provided on the support, as occasion demands.

As a component in the subbing layer, various organic compounds are used and are selected from, for example carboxymethyl cellulose, dextrin, gum arabic, a phosphonic acid having an amino group (such as 2-aminoethylphosphonic acid and the like), an organic phosphonic acid which may be substituted (such as phenylphosphonic acid, naphthylphosphonic acid, alkylphosphonic acid, glycelophosphonic acid, methylenediphosphonic acid and ethylenediphosphonic acid, and the like), an organic phosphoric acid which may be substituted (such as phenylphosphoric acid, naphthylphosphoric acid, alkylphosphoric acid and glycerophosphoric acid, and the like), an organic phosphinic acid which may be substituted (such as phenylphosphinic acid, naphthylphosphinic acid, alkylphosphinic acid and glycerophosphinic acid, and the like) amino acids such as glycine and β-alanine, amine hydrochloride having a hydroxyl group (such as triethanolamine hydrochloride and the like). Two or more of these organic compounds may be used in a mixture thereof.

The coating amount of the organic subbing layer is suitably 2 to 200 mg/m$^2$.

As described above, a planographic printing plate can be prepared by using the image recording material of the present invention. This planographic printing plate is image wisely exposed to infrared light having a wavelength of from 760 nm to 1,200nm emitted from a solid-state laser or semiconductor laser. In the present invention, the developing processing may be carried out immediately after the laser irradiation. Preferably, heating treatment of the printing plate is carried out between the laser irradiation step and the development step. Heating is preferably carried out at a temperature of 80° C. to 150° C. for 10 seconds to 5 minutes. The heating treatment can reduce the laser energy for laser irradiation necessary for image recording.

After heating treatment, as occasion demands, the present image recording material is developed with an aqueous alkaline solution.

As a developer and replenisher, a known aqueous alkaline solution can be used for the present image recording material. Examples thereof are inorganic alkali salts such as sodium silicate, potassium silicate, sodium phosphate, potassium phosphate, ammonium phosphate, disodium hydrogen phosphate, dipotassium hydrogen phosphate, diammonium hydrogen phosphate, sodium carbonate, potassium carbonate, ammonium carbonate, sodium hydrogen carbonate, potassium hydrogen carbonate, ammonium hydrogen carbonate, sodium borate, potassium borate, ammonium borate, sodium hydroxide, ammonium hydroxide, potassium hydroxide and lithium hydroxide. Further, organic alkali agents such as monomethylamine, dimethylamine, trimethylamine, monoethylamine, diethylamine, triethylamine, monoisopropylamine, diisopropylamine, triisopropylamine, n-butylamine, monoethanolamine, diethanolamine, triethanolamine, monoisopropanolamine, diisopropanolamine, ethylenimine, ethylenediamine, pyridine and the like are also used.

These alkali agents may be used alone or in combination of two or more of them.

Among developers containing these alkali agents, particularly preferable developers are an aqueous solution of a silicate such as sodium silicate, potassium silicate and the like. This is because the developing properties can be adjusted by changing the ratio and concentration of silicon oxide $SiO_2$ as a component of silicate and alkali metal oxide $M_2O$. For example, alkali metal silicates as described in Japanese Patent Application Laid-Open (JP-A) No. 54-62004, Japanese Patent Application Publication (JP-B) No. 57-7427 and the like are effectively used.

It has been known that, when development is carried out using an automatic developing machine, a large quantity of planographic printing plates can be processed without replacing a developer in a developing tank for a long period of time, by adding to the developer an aqueous solution having higher alkalinity (replenisher) than that of the developer. This replenishing method is preferably used in the present invention.

In order to enhance or suppress developing properties, or to improve scum dispersing properties formed in a developer and ink-affinity in an image part of a printing plate, various surfactants and organic solvents can be added to the developer and replenisher, if necessary. Examples of preferable surfactants are anionic, cationic, nonionic and amphoteric surfactants.

Further, a reducing agent such as hydroquinone, resorcin, sodium or a potassium salt of an inorganic acid (such as sulfurous acid, hydrogen sulfurous acid and the like), and further, organic carboxylic acids, defoaming agents and hard water softeners may be added to the developer and replenisher, if necessary.

A printing plate which has been developed, by using the above developer and replenisher is post-treated with water, a rinse solution containing surfactants and the like, and a desensitizing solution containing gum arabic or a starch derivative. When the image recording material of the present invention is used as a printing plate for printing, a variety of combinations of the above described processings may be used for post-treatment.

Recently, an automatic processing machine has been widely used in plate making and printing industries in order to rationalize and standardize the plate making operation. In general, this automatic developing machine comprises a developing section and a post-treating section, and further comprises a device for conveying a printing plate, processing tanks and spraying devices. In such an automatic processing machine, developing processing is effected by spraying processing solution pumped up by pump from a spray nozzle to an exposed printing plate, while the printing plate is being horizontally conveyed. In addition, there has also been found recently a processing method in which a printing plate is immersed in a processing solution tank filled with the processing solution while the printing plate is conveyed by guide rolls in the processing solution. In such automatic processing, the printing plate can be processed while replenishing a replenisher to each processing solution depending upon the amount of the printing plate to be processed, working time and the like.

A so-called discarding-processing which does not use a replenisher can be applied to the present invention, where a printing plate is processed with a fresh processing solution which has not been substantially used.

The planographic printing plate thus obtained can be subjected to a printing step, if desired, after being coated with desensitizing gum. When a planographic printing plate having a higher plate wear is desired, the plate is subjected to a burning treatment.

When a planographic printing plate is subjected to a burning treatment, the plate is preferably treated with a counter-etching solution as described in Japanese Patent Application Publication (JP-B) Nos. 61-2518, 55-28062, Japanese Patent Application Laid-Open (JP-A) Nos. 62-31859 and 61-159655 prior to the burning treatment.

Such a treatment includes a method of coating a counter-etching solution on the plate using a sponge or an absorbent cotton impregnated with the counter-etching solution, or coating a counter-etching solution on the plate by immersing the plate in a tray filled with the counter-etching solution, and a method of coating the counter-etching solution using an automatic coater. Further, leveling of an amount using a squeegee or squeegee roller after coating gives better results.

In general, the amount of counter-etching solution to be applied is suitably 0.03 to 0.8 g/m$^2$ (dry weight).

The planographic printing plate coated with the counter-etching solution is dried, if necessary, and heated to an elevated temperature with a burning processor (such as burning processor: BP-1300, commercially available from Fuji Photo Film Co., Ltd.). The heating temperature and duration are preferably in the range of 100° C. to 300° C. and 1 to 20 minutes, respectively, depending on the kind of components forming the image.

The burning-treated planographic printing plate may be subjected to known treatments, such as washing with water, gum coating and the like, if necessary. When a counter-etching solution containing a water-soluble polymer and the like is used, a so-called desensitizing treatment such as gum coating and the like can be omitted.

The planographic printing plate obtained by such a treatment can be employed for making a plurality of prints using an offset printing press machine and the like.

EXAMPLES

The following Examples further illustrate the present invention in detail but are not to be construed to limit the scope thereof.

Examples 1–5

After an aluminum plate (type 1050) having a thickness of 0.30 mm was washed with trichloroethylene to degrease it, the plate surface was sand-blasted using a nylon brush and an aqueous suspension of 400 mesh Pamiston and washed well with water. This plate was immersed in a 25% aqueous solution of sodium hydroxide at 45° C. for 9 seconds to etch it, washed with water, immersed in 2% $HNO_3$ for 20 seconds and again washed with water. At this point, the etched amount of the sand-blasted surface was about 3 g/m$^2$. Then, after 3 g/m$^2$ of a direct current-anodized oxide film was formed on this plate using 7% $H_2SO_4$ as an electrolysis solution at a current density of 15 A/dm$^2$, the plate was washed with water and dried. Then, the following subbing solution was coated on this aluminum plate and dried at 80° C. for 30 seconds. The coated amount after drying was 10 mg/m$^2$.

| (Subbing solution) | |
|---|---|
| β-alanine | 0.1 g |
| Phenylsulfonic acid | 0.05 g |
| Methanol | 40 g |
| Pure water | 60 g |

Then, 5 kinds of solutions [A-1] to [A-5] were prepared by varying the kind of the organic base (E) according to the present invention in the following solution [A]. These solutions were coated on aluminum plates which had been coated with the above subbing solution, respectively, followed by drying at 100° C. for 1 minute to obtain negative type planographic printing plates [A-1] to [A-5]. The weight of each solution after drying was 1.9 g/m$^2$.

| Solution [A] | |
|---|---|
| Diphenyliodonium trifluoromethanesulfonate (manufactured by Tokyo Kaseikogyo K.K.) | 0.15 g |
| Infrared absorbing agent NK-2014 (manufactured by Nippon Kankoshikiso Kenkyujo K.K.) | 0.10 g |
| Novolak resin obtained from phenol and formaldehyde (weight-average molecular weight 10000) | 1.5 g |
| Cross-linking agent [Cmpound MM-1 represented by the following structural formula] | 0.50 g |
| Organic base (E) in Table 1 | Amount listed in Table 1 |
| Fluoro type surfactant (Megafack F-177, Manufactured by Dainippon Ink & Chemicals, Inc.) | 0.03 g |
| Methyl ethyl ketone | 20 g |
| 1-Methoxy-2-propanol | 7 g |
| Methanol | 3 g |

(MM-1)

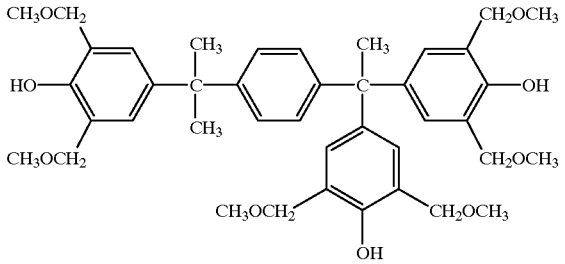

Organic basic compounds used in solutions [A-1] to [A-5] and amounts added are shown in the following Table 1.

TABLE 1

| Example No. | Planographic printing plate | Organic base (E) used | Amount added |
|---|---|---|---|
| Example 1 | [A-1] | N-phenylmorpholine | 0.008 g |
| Example 2 | [A-2] | Tri-n-octylamine | 0.010 g |
| Example 3 | [A-3] | N,N'-bis(hydroxyethyl)piperazine | 0.008 g |
| Example 4 | [A-4] | N,N-dimethylnicotineamide | 0.008 g |
| Example 5 | [A-5] | 4-(N,N- | |

TABLE 1-continued

| Example No. | Planographic printing plate | Organic base (E) used | Amount added |
|---|---|---|---|
| | | dimethylamino)pyridine | 0.010 g |
| Comparative Example 1 | [B-1] | No addition of base | — |

After the resulting negative type planographic printing plates [A-1] to [A-5] were stored under conditions of high temperature and high humidity, at a temperature of 45° C. and a humidity of 75% for 5 days, the plates were exposed to infrared rays having a wavelength of 830 nm, emitted from a semiconductor laser. After exposure, the plates were treated by heating at 120° C. for 2 minutes in an oven and processed through an automatic developing machine filled with a developer, DP-4 (1:8), and a rinse solution, FR-3 (1:7), (manufactured by Fuji Photo Film Co., Ltd.). Then, the plates were processed with a gum solution, GU-7 (1:1), (manufactured by Fuji Photo Film Co., Ltd.) and were subjected to printing by the use of a Heidel KOR-D machine. Non-image parts of prints were observed to examine whether stains were formed on the non-image parts. The results are shown in Table 2. A satisfactory print without stains on the non-image parts was obtained in each case.

Comparative Example 1

A negative type planographic printing plate [B-1] was prepared without adding the organic base (E) according to the present invention to the solution [A] used in Examples 1–5. The resulting planographic printing plate [B-1] was stored under conditions of high temperature and high humidity, at a temperature of 45° C. and a humidity of 75% for 5 days, followed by image formation and printing as in Examples 1 to 5. Non-image parts of prints were observed to examine whether stains were formed on the non-image parts. The results shown in Table 2 indicate that stains were formed on the non-image parts in Comparative Example 1. When the plate was not stored under conditions of high temperature and high humidity, stains on the non-image parts were not recognized when printing in the planographic printing plate [B-1] was carried out.

TABLE 2

| | Planographic printing plate | Stains on the non-image parts when printing |
|---|---|---|
| Example 1 | [A-1] | None |
| Example 2 | [A-2] | None |
| Example 3 | [A-3] | None |
| Example 4 | [A-4] | None |
| Example 5 | [A-5] | None |
| Comparative Example 1 | [B-1] | Observed |

It can be understood from Examples 1 to 5 and Comparative Example 1 that, when printing was performed by use of the planographic printing plates obtained by using the negative type image recording material of the present invention after storage under conditions of high temperature and high humidity, stains on the non-image parts when printing due to deterioration of the plate were not observed. The printing plates of the present invention had an excellent storability under conditions of high temperature and high humidity. On the other hand, it is clear that, in Comparative Example 1 where no organic base was added therein, storability under conditions of high temperature and high humidity is not improved.

Examples 6–8

Three kinds of solutions [D-1] to [D-3] were prepared by varying the kind of the organic base (E) according to the present invention in the following solutions [D]. These solutions were coated on aluminum plates used in Examples 1 to 5 which had been subbed respectively, followed by drying at 100° C. for 2 minutes to obtain negative type planographic printing plates [D-1] to [D-3]. The weight of each coating layer after drying was 1. 8 g/m$^2$.

The compounds used in solutions [D-l] to [D-3] are shown in Table 3.

| Solution [D] | |
|---|---|
| Diphenyliodonium trifluoromethanesulfonate (manufactured by Tokyo Kaseikogyo K.K.) | 0.15 g |
| Infrared absorbing agent NK-2014 (manufactured by Nippon Kankoshikiso Kenkyujo K.K.) | 0.10 g |
| Novolak resin obtained from cresol and formaldehyde (meta:para ratio = 8:2, weight-average molecular weight 5800) | 1.1 g |
| Resol resin obtained from bisphenol A and formaldehyde (weight-average molecular weight 1600) | 1.0 g |
| Organic base (E) in Table 3 | Amount listed in Table 3 |
| Fluoro type surfactant (Megafack F-177, Manufactured by Dainippon Ink & Chemicals, Inc.) | 0.06 g |
| Methyl ethyl ketone | 20 g |
| 1-Methoxy-2-propanol | 7 g |

TABLE 3

| | Planographic printing plate | Organic base (E) used | Amount added |
|---|---|---|---|
| Example 6 | [D-1] | N-phenylmorpholine | 0.008 g |
| Example 7 | [D-2] | Tri-n-octylamine | 0.008 g |
| Example 8 | [D-3] | 1-(2-hydroxyethyl)4-(3-hydroxypropyl)piperidine | 0.008 g |

After the resulting negative type planographic printing plates [D-1] to [D-3] were stored under conditions of high temperature and high humidity, at a temperature of 45° C. and a humidity of 75% for 5 days, the plates were exposed to infrared rays having a wavelength of 830 nm emitted from a semiconductor laser. After exposure, the plates were treated by heating at 120° C. for 2 minutes in an oven and processed through an automatic developing machine filled with a developer, DP-4 (1:8), and a rinse solution, FR-3 (1:7), (manufactured by Fuji Photo Film Co., Ltd.). Then, the plates were processed with a gum solution, GU-7 (1:1), (manufactured by Fuji Photo Film Co., Ltd.), followed by printing by the use of a Heidel KOR-D machine. Non-image parts of the prints were observed to examine whether stains were formed on the non-image parts. The results obtained are shown in Table 4. A satisfactory print without stains on the non-image parts was obtained in each case.

Comparative Example 2

A negative type planographic printing plate [E-1] was prepared in the same manner as that in Examples 6–8 except that the organic base (E) according to the present invention was not added in the solution [D] used in Examples 6–8. The resulting planographic printing plate [E-1] was stored under conditions of high temperature and high humidity, at a temperature of 45° C. and a humidity of 75% for 5 days, followed by image formation and printing as in Examples 4–6. Non-image parts of the print were observed to examine whether stains were formed on the non-image parts. The results obtained and shown in Table 4 indicate that stains were formed on the non-image parts in Comparative Example [E-1].

TABLE 4

| | Planographic printing plate | Stains on the non-image parts when printing |
|---|---|---|
| Example 6 | [D-1] | None |
| Example 7 | [D-2] | None |
| Example 8 | [D-3] | None |
| Comparative Example 2 | [E-1] | Observed |

It can be understood from Examples 6 to 8 and Comparative Example 2 that, when printing was performed by use of the planographic printing plates obtained by using the negative type image recording material of the present invention after being stored under conditions of high temperature and high humidity, stains on the non-image parts when printing due to deterioration of the plates were not observed. The printing plates of the pressent invention had an excellent storability under conditions of high temperature and high humidity.

Examples 9–10

Two kinds of solutions [F-1] to [F-2] were prepared by varying the kind of the compound represented by the general formulae according to the present invention in the following solution [F]. These solutions were coated on an aluminum plate used in Examples 1 to 5 which had been subbed respectively, followed by drying at 100° C. for 2 minutes to obtain negative type planographic printing plates [F-1] to [F-2]. The weight after drying was 1.6 g/m$^2$.

The compounds used in solutions [F-1] to [F-2] are shown in Table 5.

| Solution [F] | |
|---|---|
| Diphenyliodonium trifluoromethanesulfonate (manufactured by Tokyo Kaseikogyo K.K.) | 0.15 g |
| Infrared absorbing agent NK-2014 (manufactured by Nippon Kankoshikiso Kenkyujo K.K.) | 0.10 g |
| Poly(p-hydroxystyrene) resin (weight-average molecular weight, 8000 manufactured by Nihon Soda K.K.) | 1.5 g |
| Cross-linking agent [MM-1] | 0.50 g |
| Organic base in Table 5 | 0.008 g |
| Fluoro type surfactant (Megafack F-177, Manufactured by Dainippon Ink & Chemicals, Inc.) | 0.03 g |
| Methyl ethyl ketone | 20 g |
| 1-Methoxy-2-propanol | 7 g |
| Methanol | 3 g |

After the resulting negative type planographic printing plates [F-1] to [F-2] were stored under conditions of high temperature and high humidity, at a temperature of 45° C. and a humidity of 75% for 5 days, the plates were exposed to infrared rays having a wavelength of 830 nm emitted from a semiconductor laser. After exposure, the plates were treated by heating at 120° C. for 2 minutes and processed through an automatic developing machine filled with a developer, DP-4 (1:12), and a rinse solution, FR-3 (1:7), (manufactured by Fuji Photo Film Co., Ltd.). Then, the plates were processed with a gum solution, GU-7 (1:1), (manufactured by Fuji Photo Film Co., Ltd.), followed by printing by the use of a Heidel KOR-D machine to obtain 10,000 or more good prints having no stains on non-image parts in each case.

TABLE 5

| Example No. | Planographic printing plate | Organic base (E) used |
|---|---|---|
| Example 9 | [F-1] | 1,2-Diphenylimidazole |
| Example 10 | [F-2] | N,N-dimethylnicotineamide |

Comparative Example 3

A negative type planographic printing plate [G-1] was prepared in the same manner as that in Examples 9–10 except that the organic base (E) was not added in the solution [F] used in Examples 9–10. The resulting planographic printing plate was stored under conditions of high temperature and high humidity, at a temperature of 45° C. and a humidity of 75% for 5 days, followed by image formation and printing as in Examples 9–10. Stains were recognized on non-image parts.

It can be understood from Examples 9 and 10 and Comparative Example 3 that, when printing was performed by use of the planographic printing plates obtained by using the negative type image recording material of the present invention after being stored under conditions of high temperature and high humidity, stains on the non-image parts when printing due to deterioration of the plate was not observed. It was found that the printing plates of the present invention had excellent storability under conditions of high temperature and high humidity.

Examples 11–15

After an aluminum plate (type 1050) having a thickness of 0.30 mm was washed with trichloroethylene to degrease, the plate surface was sand-blasted using a nylon brush and an aqueous suspension of 400 mesh Pamiston and washed well with water. This plate was immersed in a 25% aqueous solution of sodium hydroxide at 45° C. for 9 seconds to etch, washed with water, immersed in 2% $HNO_3$ for 20 seconds and washed with water. At this point, an etched amount of the sand-blasted surface was about 3 g/m$^2$. Then, after 3 g/m$^2$ of a direct current-anodized oxide film was formed on this plate using 7% $H_2SO_4$ as an electrolysis solution at a current density of 15 A/dm$^2$, the plate was washed with water and dried. Then, the following subbing solution was coated on this aluminium plate and dried at 80° C. for 30 seconds. The coated amount after drying was 10 mg/m$^2$.

| (Subbing solution) | |
|---|---|
| β-alanine | 0.1 g |
| Phenylsulfonic acid | 0.05 g |
| Methanol | 40 g |
| Pure water | 60 g |

Then, 5 kinds of solutions [G-1] to [G-5] were prepared by varying the kind of amino acid derivatives (E) according to the present invention in the following solution [G]. These solutions were coated on an aluminum plate which had been subbed, respectively, followed by drying at 100° C. for 1 minute to obtain negative type planographic printing plates [G-1] to [G-5]. The weight of the coated layer after drying was 1.9 g/m$^2$.

| Solution [G] | |
|---|---|
| Diphenyliodonium trifluoromethanesulfonate (manufactured by Tokyo Kaseikogyo K.K.) | 0.15 g |
| Infrared absorbing agent NK-2014 (manufactured by Nippon Kankoshikiso Kenkyujo K.K.) | 0.10 g |
| Novolak resin obtained from phenol and formaldehyde (weight-average molecular weight 10000) | 1.5 g |
| Cross-linking agent [Cmpound MM-1 represented by the following structural formula] | 0.50 g |
| Amino acid compound (E) in Table 6 | Amount listed in Table 6 |
| Fluoro type surfactant (Megafack F-177, Manufactured by Dainippon Ink & Chemicals, Inc.) | 0.03 g |
| Methyl ethyl ketone | 20 g |
| 1-Methoxy-2-propanol | 7 g |
| Methanol | 3 g |

(MM-1)

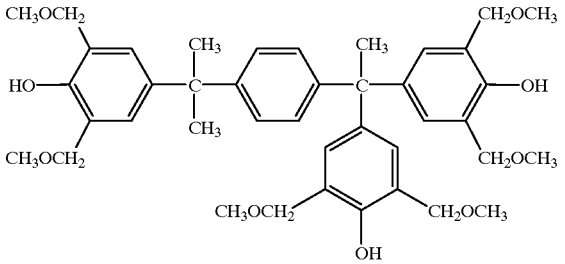

Amino acid compounds used in solutions [G-1] to [G-5] and amounts added are shown in the following Table 6.

TABLE 6

| | Planographic printing plate | Organic base (E) used | Amount added |
|---|---|---|---|
| Example 11 | [G-1] | Phenylalanine | 0.008 g |
| Example 12 | [G-2] | 4-Aminobenzoic acid | 0.010 g |
| Example 13 | [G-3] | α-phenylglycine | 0.008 g |
| Example 14 | [G-4] | Tyrosine | 0.008 g |
| Example 15 | [G-5] | Alanylalanine | 0.010 g |

After the resulting negative type planographic printing plates [G-1] to [G-5] were stored under conditions of high temperature and high humidity, at a temperature of 45° C. and a humidity of 75% for 5 days, the plates were exposed to infrared rays having wavelengths of 830 nm, emitted from a semiconductor laser. After exposure, the plates were treated by heating at 120° C. for 2 minutes in an oven and processed thorough an automatic developing machine filled with a developer, DP-4 (1:8), and a rinse solution, FR-3 (1:7), (manufactured by Fuji Photo Film Co., Ltd.). Then, the plates were processed with a gum solution, GU-7 (1:1), (manufactured by Fuji Photo Film Co., Ltd.) and subjected to printing by the use of a Heidel KOR-D machine. Non-image parts of a print were observed to examine whether stains were formed on the non-image parts. The results are shown in Table 7. A satisfactory print without stains on the non-image parts was obtained in each case.

Comparative Example 4

A negative type planographic printing plate [H-1] was prepared, in which that amino acid (E) according to the present invention was not added in the solution [G] used in Examples 11–15. The resulting planographic printing plate [H-1] was stored under conditions of high temperature and high humidity, at a temperature of 45° C. and a humidity of 75% for 5 days, followed by image formation and printing as in Examples 11 to 15. Non-image parts of a print were observed to evaluate staining on the non-image parts. The results obtained shown in Table 7 indicate that stains were formed on the non-image parts in Comparative Example [H-1]. When the printing plate was not stored under conditions of high temperature and high humidity, stains on the non-image parts were not recognized when printing by the use of the planographic printing plate [H-1].

TABLE 7

| | Planographic printing plate | Stains on the non-image parts when printing |
|---|---|---|
| Example 11 | [G-1] | None |
| Example 12 | [G-2] | None |
| Example 13 | [G-3] | None |
| Example 14 | [G-4] | None |
| Example 15 | [G-5] | None |
| Comparative Example 4 | [H-1] | Observed |

It can be understood from Examples 11 to 15 and Comparative Example 4 that, when printing was performed by use of the planographic printing plates obtained by using the negative type image recording materials of the present invention after being stored under conditions of high temperature and high humidity, stains on the non-image parts when printing due to deterioration of the plates were not observed. It was found that the printing plates of the present invention had excellent storability under conditions of high temperature and high humidity. On the other hand, it was found that, Comparative Example 4 where an amino acid compound was not added therein, did not exhibit an improved storability under conditions of high temperature and high humidity, and showed stains on non-image parts when printing.

Examples 16–18

Three kinds of solutions [I-1] to [I-3] were prepared by varying the kind of amino acid compounds (E) according to the present invention in the following solution [I]. These solutions were coated on an aluminium plate used in Examples 11 to 15 which had been subbed respectively, followed by drying at 100° C. for 2 minutes to obtain negative type planographic printing plates [I-1] to [I-3]. The weight of the coated layer after drying was 1.8 g/m$^2$.

The compounds used in solutions [I-1] to [I-3] are shown in Table 8.

| Solution [I] | |
|---|---|
| Diphenyliodonium trifluoromethanesulfonate (manufactured by Tokyo Kaseikogyo K.K.) | 0.15 g |
| Infrared absorbing agent NK-2014 (manufactured by Nippon Kankoshikiso Kenkyujo K.K.) | 0.10 g |

-continued

| Solution [I] | |
|---|---|
| Novolak resin obtained from cresol and formaldehyde (meta:para ratio = 8:2, weight-average molecular weight 5800) | 1.1 g |
| Resol resin obtained from bisphenol A and formaldehyde (weight-average molecular weight 1600) | 1.0 g |
| Amino acid compound (E) in Table 8 | Amount listed in Table 8 |
| Fluoro type surfactant (Megafack F-177, Manufactured by Dainippon Ink & Chemicals, Inc.) | 0.06 g |
| Methyl ethyl ketone | 20 g |
| 1-Methoxy-2-propanol | 7 g |

TABLE 8

| | Planographic printing plate | Organic base (E) used | Amount added |
|---|---|---|---|
| Example 16 | [I-1] | N-phenyl-β-alanine | 0.008 g |
| Example 17 | [I-2] | Tyrosine | 0.008 g |
| Example 18 | [I-3] | Nicotinic acid | 0.007 g |

After the resulting negative type planographic printing plates [I-1] to [I-3] were stored under conditions of high temperature and high humidity, at a temperature of 45° C. and a humidity of 75% for 5 days, the plates were exposed to infrared rays having a wavelength of 830 nm emitted from a semiconductor laser. After exposure, the plates were treated by heating at 120° C. for 2 minutes in an oven and processed through an automatic developing machine filled with a developer, DP-4 (1:8), and a rinse solution, FR-3 (1:7), (manufactured by Fuji Photo Film Co., Ltd.). Then, the plates were processed with a gum solution, GU-7 (1:1), (manufactured by Fuji Photo Film Co., Ltd.), followed by printing by the use of a Heidel KOR-D machine. Non-image parts of the print were observed to see if stains were formed on the non-image parts. The results are shown in Table 9. A satisfactory print without stains on the non-image parts was obtained in each case.

Comparative Example 5

A negative type planographic printing plate [J-1] was prepared in the same manner as that in Examples 16–18 except that amino acid compound (E) according to the present invention was not added in the solution [I] used in Examples 16–18. The resulting planographic printing plate [J-1] was stored under conditions of high temperature and high humidity, at a temperature of 45° C. and a humidity of 75% for 5 days, followed by image formation and printing as in Examples 16–18. Non-image parts of a print were observed to see if stains were formed on the non-image parts. The results shown in Table 9 indicate that stains were formed on the non-image parts in Comparative Example [J-1].

TABLE 9

| | Planographic printing plate | Stains on the non-image parts when printing |
|---|---|---|
| Example 16 | [I-1] | None |
| Example 17 | [I-2] | None |
| Example 18 | [I-3] | None |
| Comparative Example 5 | [J-1] | Observed |

It can be understood from Examples 16 to 18 and Comparative Example 5 that, when printing was performed by use of the planographic printing plates obtained by using the negative type image recording material of the present invention after being stored under high temperature and high humidity, stains on the non-image parts when printing due to deterioration of the plates were not observed. It was found that the printing plates of the present invention had excellent storability under conditions of high temperature and high humidity.

The negative type image recording material of the present invention has the effects that when it is used for a negative type planographic printing plate material, direct plate making can be effected by recording using a solid-state laser or a semiconductor laser emitting an infrared-ray based on digital signals outputted from a computer or the like, and the image recording material has an excellent storability, particularly, storability under conditions of high temperature and high humidity.

What is claimed is:

1. A photosensitive negative image recording material for a planographic printing plate having an image recording layer containing the following components on a support:

a compound (A) which is degraded by the action of light or heat to generate an acid, a cross-linking agent (B) which cross-links in the presence of an acid, at least one alkali-soluble resin (C), an infrared absorbing agent (D), and at least one amino acid or derivative thereof wherein the amino acid is selected from the group consisting of glycine, β-alanine, valine, norvaline, leucine, norleucine, phenylalanine, tyrosine, diiodotyrosine, surinamine, serine, proline, hydroxyproline, tryptophan, thyroxine, cystine, cysteine, γ-aminobutyric acid, glutamine, lysine, hydroxylysine, arginine and histidine.

2. A photosensitive negative image recording material according to claim 1, wherein said amino acid derivative is an amino acid having an N-substituent selected from the group consisting of an alkyl group, vinyl group, alkenyl group, aryl group and aralkyl group which have less than 15 carbon atoms.

3. A photosensitive negative image recording material according to claim 2, wherein said amino acid or derivatives thereof is contained in an amount of 0.001 to 10 parts by weight based on 100 parts by weight of total solid components of the image recording layer of said negative image recording material.

4. A photosensitive negative image recording material according to claim 2, wherein said compound which is degraded by the action of light or heat to generate an acid is a compound which generates an acid by irradiating with light having wavelengths of 200 to 500 nm or by heating at a temperature of 100° C. or higher.

5. A photosensitive negative image recording material according to claim 4, wherein said compound which is degraded by the action of light or heat to generate an acid is at least one onium salt selected from the group consisting of iodonium salt, sulfonium salt and diazonium salt.

6. A photosensitive negative image recording material according to claim 1, wherein said amino acid or derivatives thereof is contained in an amount of 0.001 to 10 parts by weight based on 100 parts by weight of total solid components of the image recording layer of said negative image recording material.

7. A photosensitive negative image recording material according to claim 6, wherein said compound which is degraded by the action of light or heat to generate an acid is a compound which generates an acid by irradiating with light having wavelengths of 200 to 500 nm or by heating at a temperature of 100° C. or higher.

8. A photosensitive negative image recording material according to claim 7, wherein said compound which is degraded by the action of light or heat to generate an acid is at least one onium salt selected from the group consisting of iodonium salt, sulfonium salt and diazonium salt.

9. A photosensitive negative image recording material according to claim 1, wherein said compound which is degraded by the action of light or heat to generate an acid is a compound which generates an acid by irradiating with light having wavelengths of 200 to 500 nm or by heating at a temperature of 100° C. or higher.

10. A photosensitive negative image recording material according to claim 9, wherein said compound which is degraded by the action of light or heat to generate an acid is at least one onium salt selected from the group consisting of iodonium salt, sulfonium salt and diazonium salt.

* * * * *